US006750891B2

(12) United States Patent
Kamoshida et al.

(10) Patent No.: US 6,750,891 B2
(45) Date of Patent: Jun. 15, 2004

(54) IMAGE FORMING APPARATUS FOR FORMING AN ELECTROSTATIC LATENT IMAGE

(75) Inventors: Shinichi Kamoshida, Nagano-Ken (JP); Kenjiro Yoshioka, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/245,708

(22) Filed: Sep. 18, 2002

(65) Prior Publication Data

US 2003/0071885 A1 Apr. 17, 2003

(30) Foreign Application Priority Data

Sep. 21, 2001 (JP) ..... 2001-289087
Sep. 25, 2001 (JP) ..... 2001-290482
Sep. 25, 2001 (JP) ..... 2001-290484
Sep. 27, 2001 (JP) ..... 2001-296596

(51) Int. Cl.[7] ..... B41J 2/41
(52) U.S. Cl. ..... 347/117; 347/141; 399/313
(58) Field of Search ..... 347/112, 115, 347/117, 141, 147; 399/121, 302, 308, 313

(56) References Cited

U.S. PATENT DOCUMENTS 5,812,170 A * 9/1998 Kuehnle et al. ..... 347/147

FOREIGN PATENT DOCUMENTS

| | | | |
|---|---|---|---|
| JP | 63-45104 B2 | | 9/1988 |
| JP | 6-166206 A | | 6/1994 |
| JP | 6-317994 A | * | 11/1994 |
| JP | 11-198433 A | | 7/1999 |
| JP | 2000-77188 A | | 3/2000 |

* cited by examiner

*Primary Examiner*—Joan Pendegrass
(74) *Attorney, Agent, or Firm*—Sughrue Mion, PLLC

(57) ABSTRACT

In an image forming apparatus of the present invention, the voltage of a chargeable layer 2*b* of an image carrier 2 at the portion to be in contact with writing electrodes 3*b* is adjusted by a surface potential adjusting member 8 which is disposed to be in contact with the chargeable layer 2*b* between the writing electrodes 3*b* and a transfer roller 6*a*. That is, even if the reverse charge injection occurs because the transfer voltage is applied to the transfer roller 6*a* and the transfer roller 6*a* is in contact with the chargeable layer 2*b* of the image carrier 2 at an interval between a printed paper 5 and the next paper 5, the potential of the chargeable layer 2*b* at the portion to be in contact with the writing electrodes 3*b* is adjusted not to exceed the withstand voltage of IC drivers 7 of the writing electrodes 3*b* by the surface potential adjusting member 8. Therefore, this prevents the writing head 3 from being broken, prevents the production of ghost image, and further inhibits voltage drop due to discharge between the image carrier and the writing electrodes during the process of writing a latent image, thereby preventing the electrostatic latent image from being in disorder.

27 Claims, 17 Drawing Sheets

IN CASE OF SURFACE POTENTIAL AJUSTING MEMBER OF ROLLER TYPE

IN CASE OF SURFACE POTENTIAL ADJUSTING MEMBER OF PLATE TYPE (WRITING HEAD + IMAGE CARRIER, CARTRIDGE)

WRITING HEAD AND IMAGE CARRIER FIXED TO COMMIN FRAME

WRITING HEAD AND IMAGE CARRIER FIXED TO COMMON FRAME
(IN CASE OF TANDEM TYPE, WHEN REMOVED)

(WRITING HEAD + IMAGE CARRIER,CARTRIDGE)

WRITING HEAD AND IMAGE CARRIER FIXED TO COMMON FRAME
(IN CASE OF TANDEM TYPE, WHEN INSTALLED)

(WRITING HEAD + IMAGE CARRIER,CARTRIDGE)

WRITING HEAD + IMAGE CARRIER (WRITING HEAD + IMAGE CARRIER,CARTRIDGE)

WRITING HEAD + IMAGE CARRIER +
DEVELOPING DEVICE + TRANSFERRING DEVICE (WRITING HEAD + IMAGE CARRIER,CARTRIDGE)

WRITING HEAD + IMAGE CARRIER (WRITING HEAD + IMAGE CARRIER,CARTRIDGE)

WRITING HEAD + IMAGE CARRIER +
DEVELOPING DEVICE + TRANSFERRING DEVICE

When transfer is conducted
(The transfer member is brought into contact with the image carrier)

When transfer is not conducted
(The transfer member is spaced apart from the image carrier)

IMAGE FORMING APPARATUS FOR FORMING AN ELECTROSTATIC LATENT IMAGE

BACKGROUND OF THE INVENTION

The present invention relates to an image forming apparatus which forms an electrostatic latent image on an image carrier by using writing electrodes of a writing head, thereby forming the image.

In a conventional image forming apparatus such as an electrostatic copying machine and a printer, the surface of a photoreceptor is uniformly charged by a charging device and the uniformly charged surface of the photoreceptor is then exposed to light from an exposure device such as laser beam or LED light, whereby an electrostatic latent image is written on the surface of the photoreceptor. Then, the electrostatic latent image on the surface of the photoreceptor is developed by a developing device to form a developer image on the surface of the photoreceptor. The developer image is transferred to a recording medium such as a paper, thereby forming the image.

In such conventional image forming apparatus, the exposure device as a writing device for electrostatic latent image comprises a laser beam generating device or a LED light generating device. Therefore, the entire image forming apparatus should be large and complex.

Therefore, an image forming apparatus has been proposed in Japanese Patent Publication No. S63-45104 (hereinafter, '104B publication) which employs electrodes, as a writing device for forming an electrostatic latent image, to write an electrostatic latent image on a surface of a image carrier without using any of laser beams and LED lights.

The image forming apparatus disclosed in the '104B publication is provided with a multi-stylus having a large number of needle electrodes. The needle electrodes are just arranged in contact with an inorganic glass layer on the surface of the image carrier. In accordance with an input signal for image information, voltage is selectively applied to corresponding ones of the needle electrodes of the multi-stylus, whereby the electrostatic latent image can be formed on the image carrier. Since the image forming apparatus according to the '104B publication does not use an exposure device conventionally used as a writing device, the invention of this publication makes it possible to provide an image forming apparatus which is relatively small in size and relatively simple in structure.

In addition, an image forming apparatus has been proposed in Japanese Unexamined Patent Publication No. H06-166206 (hereinafter, '206A publication), comprising ion control electrodes which are disposed on a front end portion of an insulating substrate and are arranged in non-contact with an image carrier, wherein the ion control electrodes control ions generated by a corona discharger so as to write an electrostatic latent image on the image carrier. Since the image forming apparatus according to the '206A publication also does not use an exposure device as a writing device, the invention of this publication makes it possible to provide an image forming apparatus which is relatively small in size and relatively simple in structure.

However, in the image forming apparatus according to the '104B publication, the large number of needle electrodes of the multi-stylus are just arranged in contact with the inorganic glass layer on the surface of the image carrier. It is difficult to keep the stable contact between the needle electrodes and the inorganic glass layer on the surface of the image carrier. Accordingly, it is difficult to stably apply charge to the surface of the image carrier. This means that it is hard to obtain a high quality image.

Moreover, it is unavoidable to employ an inorganic glass layer on the surface of the image carrier for protecting the surface of the image carrier from damage due to contacts of the large number of needle electrodes. This makes the structure of the image carrier more complex. In addition, since the inorganic glass layer has quite well physical adsorbed water characteristic, moisture is easily adsorbed by the surface of the inorganic glass layer. Due to the moisture, the electrical conductivity of the glass surface is increased so that electrostatic charge on the image carrier should leak. Therefore, the image forming apparatus should be provided with a means for drying the surface of the image carrier with adsorbed moisture in order to prevent the apparatus from being affected by absorbed water. This not only makes the apparatus larger but also increases the number of parts, leading to problems of making the structure further complex and increasing the cost.

Since the large number of needle electrodes discharge, the apparatus has another problem that there is a high possibility of generation of ozone ($O_3$). The presence of ozone may not only produce rusts on parts in the apparatus but also melt resin parts because ozone reacts with $NO_x$ to generate nitric acid ($HNO_3$). Again ozone may give an offensive smell. Therefore, the image forming apparatus should be provided with a ventilation system including a duct and an ozone filter which sufficiently exhausts ozone from the inside of the apparatus. This also not only makes the apparatus larger but also increases the number of parts, leading to problems of making the structure further complex and increasing the cost.

On the other hand, in the image forming apparatus according to the '206A publication, ions produced by the corona discharger are controlled by the ion control electrodes. This means that the apparatus is structured not to directly inject electric charge to the image carrier. The invention of the '206A publication has problems of not only making the image forming apparatus larger and but also making the structure complex. Since the application of charge is conducted by ions, it is difficult to stably write an electrostatic latent image on the image carrier.

Further, since the generation of ions essentially generates ozone, there are problems similar to those described with regard to the image forming apparatus according to '104B publication.

In order to solve the above problems, the applicant of this application filed a patent application to Japanese Patent Office (Japanese Patent Application No. 2001-227630, hereinafter '630 application) proposing an image forming apparatus which makes it possible to reduce the size thereof and reduce the number of parts thereof so as to have more simple and low-priced structure, to more stably write an electrostatic latent image, and to inhibit the generation of ozone.

Since the details of the image forming apparatus proposed in the '630 application will be easily understood by persons skilled in the art on consideration of the specification and drawings of the patent application, the details thereof will be omitted here. Only parts directly related to the present invention will be briefly described.

FIG. 1 is an illustration schematically showing the basic structure of the image forming apparatus proposed in the '630 application.

As shown in FIG. 1, the image forming apparatus 1 comprises an image carrier 2 having a substrate 2*a* which is made of a conductive material such as aluminum and is grounded and a chargeable layer 2*d* which is formed on the outer periphery of the substrate 2*a* and has an insulating property and on which a electrostatic latent image is formed, a writing head 3 having a flexible substrate 3*a*, having high insulation property and being relatively soft and elastic, such as a FPC (Flexible Print Circuit: hereinafter, referred to as "FPC") or a PET (polyethylene terephthalate: hereinafter, referred to as "PET"), and writing electrodes 3*b* which are supported by the substrate 3*a* and which are pressed lightly against the image carrier 2 with weak elastic restoring force created by deflection of the substrate 3*a* so that the writing electrodes 3*b* are in plane contact with the charged layer of the image carrier 2 to write the electrostatic latent image, a developing device 4 having a developer carrier (hereinafter, sometimes referred to as "development roller") 4*a*, and a transferring device 6 having a transfer roller 6*a* as a transfer member.

In the image forming apparatus 1 having a structure as mentioned above, after the chargeable layer 2*b* of the image carrier 2 is made into the uniformly charged state, writing voltage is applied to the writing electrodes 3*b* via IC drivers 7, and an electrostatic latent image is written on the chargeable layer 2*b* of the image carrier 2 mainly via the charge transfer (hereinafter, sometimes referred to as "contact-charge transfer") between image carrier 2 and the writing electrodes 3*b* of the writing head 3 which are in plane contact with each other. The electrostatic latent image on the chargeable layer 2*b* of the image carrier 2 is then developed with developer carried by the development roller 4*a* of the developing device 4 to form a developer image and the developer image is transferred to the recording medium 5, such as a paper or an intermediate transfer medium, by the transfer roller 6*a* of the transferring device 6 to which transfer voltage is applied. Though the following description of the present invention will be made using paper as typical of the recording medium 5, it will be understood that media other than paper can be used as the recording medium 5.

In the writing process by the writing electrodes 3*b* of the writing head 3 as described above, in case of successively printing monochrome images, the transfer roller 6*a* is in contact with the chargeable layer 2*b* of the image carrier 2 after an image is printed on a paper 5 before the next paper 5 reaches the transferring device 6 as shown in FIG. 2. If the transfer voltage is continuously applied to the transfer roller 6*a* even during this, a potential corresponding to the transfer voltage is applied on the chargeable layer 2*b* of the image carrier 2. In this state, as the writing is conducted by the writing electrodes 3*b*, an electric current of high voltage exceeding the withstand voltage of the IC drivers 7 connected to the writing electrodes 3*b* is applied to the writing electrodes 3*b*, thus braking the writing head 3. Particularly, when the transfer voltage is increased in order to carry out the transfer in such an environment (LL environment) of low temperature (for example, 15° C.) and low humidity (for example, 23% R.H.), the IC drivers 7 may be also broken.

If charge injection from the transfer roller 6*a* of the transferring device 6 onto the chargeable layer 2*b* of the image carrier 2, i.e. reverse charge injection, takes place, the rule of writing potentials in subsequent selective charging is disturbed, thus producing a ghost image and causing voltage drop due to discharge between the image carrier 2 and the writing electrodes 3*b* during the process of writing a latent image. Such voltage drop puts the electrostatic latent image into disorder.

If the writing electrodes 3*b* and the image carrier 2 are in contact with each other in the state where the reverse charge injection takes place at the transfer portion, an electric potential difference exceeding the discharge starting voltage is applied. Vibration may be produced due to the relation with the frequency of ON/OFF signals applied to the writing electrodes 3*b* for writing an electrostatic latent image. Such vibration enhances the instability in contact between the writing electrodes 3*b* and the image carrier 2 and loses stable reproducibility of latent images.

When the writing positions (that is, the contact positions of the writing electrodes 3*b* relative to the chargeable layer 2*b*) are shifted or the contact pressures of the writing electrodes 3*b* against the chargeable layer 2*b* vary during the process of writing an electrostatic latent image onto the chargeable layer 2*b* by the writing electrodes 3*b* of the writing head 3, the latent image and the developer image may be in disorder. In particular, the contact pressures between the writing electrodes 3*b* and the image carrier 2 are affected by the contact resistance during the charge transfer between the writing electrodes 3*b* and the image carrier 2, thus affecting the image forming speed (charge and discharge speed) and the image forming stability.

Therefore, it is desired to install the image carrier 2 and the writing electrodes 3*b* into the body frame of the image forming apparatus to define the writing positions of the writing electrodes 3*b* and the contact pressures of the writing electrodes 3*b* against the chargeable layer 2*b* as precise as possible, in order to obtain high quality images. It is also desired to facilitate such installation.

SUMMARY OF THE INVENTION

It is an object of the present invention to provide an image forming apparatus capable of preventing reverse charge injection from a transfer member to an image carrier at a transferring portion as completely as possible so as to obtain stable reproducibility of latent images and capable of controlling the potential of the image carrier to adjust the voltage of a writing head not to exceed the withstand voltage of the writing head so as to make it possible to protect IC drivers of writing electrodes even if the reverse charge injection from the transfer member to the image carrier occurs.

It is another object of the present invention to provide an image forming apparatus capable of more stably writing an electrostatic latent image and making it possible to precisely and easily set the writing positions and the contact pressure of writing electrodes.

It is still another object of the present invention to provide an image forming apparatus capable of obtaining stable reproducibility of latent images by preventing the occurrence of reverse charge injection from the transferring member to the image carrier when transfer is not conducted and yet achieving reduction in size and reduction in the number of parts thereof so as to have more simple and low-priced structure.

In order to achieve these objects, the present invention provides an image forming apparatus comprising at least: an image carrier having a chargeable layer on which an electrostatic latent image is formed; a writing head having writing electrodes which are in contact with said chargeable layer of said image carrier to write said electrostatic latent image; a developing device having a developer carrier for carrying developer for developing said electrostatic latent image on said image carrier; a transferring device having a transfer member which is disposed to be in contact with said chargeable layer of said image carrier to transfer the developer image, developed by the developing device, on said image carrier to a recording medium; and a surface potential adjusting member which is disposed to be in contact with said chargeable layer between said writing electrodes and said transfer member and to which a predetermined voltage including 0 (zero) V is applied for adjusting the voltage of said chargeable layer at the portion to be in contact with said writing electrodes.

The present invention is characterized in that said surface potential adjusting member rotates to have a predetermined peripheral surface speed ratio relative to said image carrier.

The present invention is characterized in that said surface potential adjusting member has a cleaning function.

The present invention is characterized in that said surface potential adjusting member is a rotatable conductive roller.

The present invention is characterized in that said conductive roller is any one of a group consisting of a conductive fur brush, a conductive rubber roller, and a conductive magnetic brush.

The present invention is characterized in that said predetermined voltage to be applied to said surface potential adjusting member is a voltage composed of an alternating current voltage superimposed on a direct current voltage.

The present invention is characterized in that the value of said direct current voltage is set to be equal to the value of a bias voltage to be applied to said image carrier.

The present invention is characterized in that the timing for conducting the application of voltages after the start of image forming is set such that the application of voltage to the surface potential adjusting member is first conducted for removing charge of said image carrier among the application of voltage to said image carrier, the application of voltage to said writing electrodes, the application of voltage to said developer carrier, the application of voltage to said transfer member, and the application of voltage to said surface potential adjusting member.

The present invention is characterized in that the timing for stopping the application of voltages after the finish of the image forming process is set such that the application of voltage to the surface potential adjusting member is last stopped for removing charge of said image carrier among the application of voltage to said image carrier, the application of voltage to said writing electrodes, the application of voltage to said developer carrier, the application of voltage to said transfer member, and the application of voltage to said surface potential adjusting member.

The present invention is characterized in that image carrier units each composed of said writing head, said developing device, said image carrier, and said surface potential adjusting member are provided for four colors of yellow, magenta, cyan, and black, respectively and that said image carrier units are disposed such that said image carriers thereof are in contact with an intermediate transfer medium and arranged sequentially along the moving direction of said intermediate transfer medium.

Further, the present invention also provides an image forming apparatus comprising at least: an image carrier on which an electrostatic latent image is formed; a writing head for writing said electrostatic latent image onto said image carrier by writing electrodes thereof; a developing device for developing said electrostatic latent image on said image carrier with developer; and a transferring device for transferring the developer image, developed by the developing device, on said image carrier, wherein said electrostatic latent image written on said image carrier by the writing electrodes of said writing head is developed by said developing device to form a developer image and the developer image on said image carrier is transferred by said transferring device, thereby forming an image, and wherein said writing head and said image carrier are positioned and fixed to a common frame.

The present invention is characterized in that said writing head, said image carrier, and said frame are structured as a cartridge.

The present invention is characterized in that at least one of said developing device and said transferring device is also positioned and fixed to said frame.

The present invention is characterized in that said writing head, said image carrier, at least one of said developing device and said transferring device, and said frame are structured as a cartridge.

The present invention further provides an image forming apparatus comprising at least: an image carrier on which an electrostatic latent image is formed; a writing head for writing said electrostatic latent image onto said image carrier by writing electrodes thereof; a developing device for developing said electrostatic latent image on said image carrier with developer; and a transferring device for transferring the developer image, developed by the developing device, on said image carrier, wherein said electrostatic latent image written on said image carrier by the writing electrodes of said writing head is developed by said developing device to form a developer image and the developer image on said image carrier is transferred by said transferring device, thereby forming an image and wherein said writing head and said image carrier are structured as a cartridge.

The present invention is characterized in that at least one of said developing device and said transferring device is also structured as another component of said cartridge.

The present invention provides an image forming apparatus comprising at least: image carriers which are provided for four colors of yellow, magenta, cyan, and black, respectively and on which electrostatic latent images of the corresponding colors are formed, respectively; writing heads which are provided to correspond to said image carriers for the four colors, respectively and each of which writes said electrostatic latent image of the corresponding color by writing electrodes thereof for the corresponding color; and developing devices which are provided to corresponding to said image carriers for the four colors, respectively and each of which develops said electrostatic latent image on said image carrier of the corresponding color with the corresponding color developer, wherein pairs of said image carriers and said writing heads, each pair being composed of the image carrier and the writing head for the same color, are arranged sequentially in tandem and wherein said image carrier and said writing head of each pair are positioned and fixed to a common frame.

The present invention further provides an image forming apparatus comprising at least: an image carrier having a chargeable layer on which an electrostatic latent image is formed; a writing head having writing electrodes which are in contact with said chargeable layer to write said electrostatic latent image; a developing device for developing said electrostatic latent image on said image carrier with developer; and a transferring device having a transfer member which comes in contact with said chargeable layer of said image carrier so that the developer image, developed by the developing device, on said image carrier is transferred to a recording medium; wherein the transfer voltage applied to said transfer member is set such that the transfer voltage when said transfer member is in contact with said image carrier never exceeds the maximum applied voltage to said writing electrodes.

The present invention furthermore provides an image forming apparatus comprising at least: an image carrier having a chargeable layer on which an electrostatic latent image is formed; a writing head having writing electrodes which are in contact with said chargeable layer to write said electrostatic latent image; a developing device for developing said electrostatic latent image on said image carrier with developer; an intermediate transfer medium which comes in contact with said chargeable layer of said image carrier so that the developer image, developed by the developing device, on said image carrier is transferred to said intermediate transfer medium; and a transferring device having a transfer member for transferring the developer image on said intermediate transfer medium to a recording medium; wherein the intermediate transfer voltage applied to said intermediate transfer member is set such that the intermediate transfer voltage when said intermediate transfer medium is in contact with said image carrier never exceeds the maximum applied voltage to said writing electrodes.

The present invention still further provides an image forming apparatus comprising at least: an image carrier having a chargeable layer on which an electrostatic latent image is formed; a writing head having writing electrodes which are in contact with said chargeable layer to write said electrostatic latent image; a developing device for developing said electrostatic latent image on said image carrier with developer; a transferring device having a transfer member which brings a recording medium into contact with said chargeable layer of said image carrier to transfer the developer image on said image carrier to said recording medium by transfer voltage applied to said transfer member; and a transfer member shifting mechanism which biases said transfer member against said chargeable layer to bring said recording medium into contact with said chargeable layer when said transfer voltage is applied and the operation of transferring the developer image on said image carrier to said recording medium is conducted and which separates said transfer member from said chargeable layer when the operation of transferring the developer image on said image carrier to said recording medium is not conducted.

The present invention is characterized by further comprising a surface potential adjusting member which is disposed to be in contact with said chargeable layer between said writing electrodes and said transfer member and to which a predetermined voltage including 0 (zero) V is applied for adjusting the voltage of said chargeable layer at the portion to be in contact with said writing electrodes.

The present invention provides an image forming apparatus comprising at least: an image carrier having a chargeable layer on which an electrostatic latent image is formed; a writing head having writing electrodes which are in contact with said chargeable layer to write said electrostatic latent image; a developing device for developing said electrostatic latent image on said image carrier with developer; an intermediate transfer medium which comes in contact with said chargeable layer of said image carrier so that the developer image, developed by the developing device, on said image carrier is primarily transferred to said intermediate transfer medium; and a primary transferring device having a primary transfer member which brings said intermediate transfer medium into contact with said chargeable layer of said image carrier to primarily transfer the developer image on said image carrier to said intermediate transfer medium by transfer voltage applied to said primary transfer member; and a transfer member shifting mechanism which biases said primary transfer member against said chargeable layer to bring said intermediate transfer medium into contact with said chargeable layer when said transfer voltage is applied and the operation of primarily transferring the developer image on said image carrier to said intermediate transfer medium is conducted and which separates said primary transfer member from said intermediate transfer medium when the operation of primarily transferring the developer image on said image carrier is not conducted.

The present invention is characterized by further comprising a surface potential adjusting member which is disposed to be in contact with said chargeable layer between said writing electrodes and said primary transfer member and to which a predetermined voltage including 0 (zero) V is applied for adjusting the voltage of said chargeable layer at the portion to be in contact with said writing electrodes.

The present invention provides an image forming apparatus comprising; image carrier units provided for four colors of yellow, magenta, cyan, and black, respectively, each of said image carrier unit being composed of an image carrier having a chargeable layer on which an electrostatic latent image is formed, a writing head having writing electrodes which are in contact with said chargeable layer to write said electrostatic latent image, and a developing device for developing said electrostatic latent image on said image carrier with developer, wherein said image carrier units for respective colors are disposed such that said image carriers thereof are in contact with an intermediate transfer medium and arranged sequentially along the moving direction of said intermediate transfer medium, and wherein said image forming apparatus further comprises primary transferring devices provided for the respective colors, each of said primary transferring device having a primary transfer member which brings said intermediate transfer medium into contact with said chargeable layer of the corresponding image carrier so that the developer image on said image carrier is primarily transferred to said intermediate transfer medium by transfer voltage applied to said primary transfer member, and transfer member shifting mechanisms provided for the respective colors, each of which biases said primary transfer member against said chargeable layer to bring said intermediate transfer medium into contact with said chargeable layer when said transfer voltage is applied and the operation of primarily transferring the developer image on said image carrier to said intermediate transfer medium is conducted and separates said primary transfer member from said chargeable layer when the operation of primarily transferring the developer image on said image carrier is not conducted.

The present invention is characterized by further comprising surface potential adjusting members provided for the respective colors, each of which is disposed to be in contact with said chargeable layer between said writing electrodes and said primary transfer member and to which a predetermined voltage including 0 (zero) V is applied for adjusting the voltage of said chargeable layer at the portion to be in contact with said writing electrodes.

In the image forming apparatus of the present invention structured as mentioned above, the surface potential adjusting member to which a predetermined voltage including 0 (zero) V is applied is disposed to be in contact with the chargeable layer between the writing electrodes and the transfer member and adjusts the voltage of said chargeable layer at the portion to be in contact with said writing electrodes. In the state that the transfer voltage is applied to the transfer member, when the transfer member is in contact with the chargeable layer of the image carrier during a period after the previous paper is sent off and before the next paper reaches or when the non-image area of the intermediate transfer medium comes in contact with the image carrier, reverse charge injection from the transfer roller onto the chargeable layer of the image carrier may occur. Even if the reverse charge injection occurs, the potential of the chargeable layer at its portion to be in contact with the writing electrodes is adjusted not to exceed the withstand voltage of the IC drivers of the writing electrodes by the surface potential adjusting member.

Therefore, this prevents the writing head from being broken, prevents the production of ghost image, and further inhibits voltage drop due to discharge between the image carrier and the writing electrodes during the process of writing a latent image, thereby preventing the electrostatic latent image from being in disorder.

Even when the transfer voltage is increased for conducting the transfer in the environment of low-temperature and low-humidity (LL), the IC drivers of the writing electrodes can be prevented from being broken.

Since the potential of the chargeable layer at the portion to be in contact with the writing electrodes is adjusted not to exceed the withstand voltage of the IC drivers, an electric potential difference exceeding the discharge starting voltage does not exist when the writing electrodes and the image carrier are in contact with each other. Production of vibration due to static electricity can be thus prevented in spite of the frequency of ON/OFF signals applied to the writing electrodes. Accordingly, the contact between the writing electrodes and the image carrier can be stabilized, thereby obtaining excellent reproducibility of latent images.

The surface potential adjusting member has a predetermined peripheral surface speed ratio relative to the image carrier, thus improving the potential adjustment of the chargeable layer. In addition, the surface potential adjusting member is composed of a rotatable conductive roller such as a conductive fur brush, a conductive rubber roller, or a conductive magnetic brush so as to increase the situation where the conductive roller is in contact with the image carrier, thereby further improving the potential adjustment of the chargeable layer. By designing the conductive roller to be in elastically contact with the image carrier, the contact ability is improved, further improving the potential adjustment of the chargeable layer of the image carrier.

Since the surface potential adjusting member has a cleaning function, the residual developer remaining on the image carrier after transfer can be removed by the surface potential adjusting member. If residual developer remains adhering to the image carrier and the peripheral surface speed ratio between the surface potential adjusting member and the image carrier is 1, the potential of the chargeable layer may be insufficiently adjusted. However, the residual developer on the image carrier can be surely removed because of the cleaning function, thereby ensuring the potential adjustment of the chargeable layer and preventing developer from adhering to the writing electrodes.

The surface potential adjusting bias voltage to be applied to the surface potential adjusting member is set to a voltage composed of an alternative current voltage having a suitable frequency superimposed on a direct current set as a reference voltage (for example, ground reference voltage) to be applied to the image carrier, thereby efficiently collecting negatively charged residual developer remaining on the image carrier after transfer and securely adjusting the surface potential of the chargeable layer of the image carrier to the reference bias voltage (for example, the ground reference voltage).

Since the timing for conducting the application of voltages after the start of image forming is set such that the application of voltage to the surface potential adjusting member is first conducted for removing charge of said image carrier among the application of voltage to said image carrier, the application of voltage to said writing electrodes, the application of voltage to said developer carrier, the application of voltage to said transfer member, and the application of voltage to said surface potential adjusting member, the surface potential of the chargeable layer of the image carrier can be securely adjusted to the reference bias voltage (for example, ground reference voltage).

On the other hand, since the timing for stopping the application of voltages after the finish of the image forming process is set such that the application of voltage to the surface potential adjusting member is last stopped for removing charge of said image carrier among the application of voltage to said image carrier, the application of voltage to said writing electrodes, the application of voltage to said developer carrier, the application of voltage to said transfer member, and the application of voltage to said surface potential adjusting member, whereby the surface potential of the chargeable layer of the image carrier can be securely adjusted to the reference bias voltage (for example, ground reference voltage).

The writing head and the image carrier are positioned and fixed to the common frame, thereby making it possible to precisely set the writing position of the writing electrodes of the writing head relative to the image carrier and making the contact pressure of the writing electrodes to the image carrier constant. Therefore, this prevents the latent image and its developer image from being in disorder. In addition, since the contact pressure of the writing electrodes to the image carrier is made constant, the charging and discharging speed i.e. the latent image forming speed can be stabilized and the latent image forming stability is improved. Accordingly, stable high-quality images can be obtained.

Since the writing head and the image carrier are previously fixed to the common frame, it is not necessary to align the writing electrodes with the image carrier and to adjust the contact pressure when installed to the body frame of the image forming apparatus, thereby easily and precisely mounting the writing head and the image carrier to the predetermined position of the body frame of the image forming apparatus.

Since the writing electrodes are in plain contact with the image carrier, the application of charge can be dominated by the charge-transfer between the writing electrodes and the latent image carrier which are in contact with each other and the charge-transfer can be stably and reliably conducted. The charge-transfer makes it possible to stably and easily write electrostatic latent image on the image carrier.

The image carrier, the writing head, at least one of the developing device and the transferring device are positioned and fixed to the common frame, thereby still further precisely conducting the formation of images and providing higher quality images.

The image carrier, the writing head, and the frame, or the image carrier, the writing head, at least one of the developing device and the transferring device, and the frame are structured as a cartridge, thus significantly facilitating the installation and the replacement of the writing head and the image carrier relative to the body frame of the image forming apparatus.

Since the image carrier and the writing head, or the image carrier, the writing head, at least one of the developing device and the transferring device are structured as a cartridge, the necessity of the flame can be eliminated, thus reducing the number of parts and further facilitating the attachment or exchange of these relative to the body frame of the image forming apparatus.

The writing head and the image carrier of each pair for each color of yellow, magenta, cyan, or black are fixed to the corresponding frame not to shift the relative position thereof, thereby making it possible to precisely set the writing positions of latent images to be written by the writing electrodes for the respective colors. This makes it possible to precisely tone the colors and position the latent images so as to provide high-quality full-color images.

Since the writing heads and the image carriers for the respective colors are previously fixed to the common frame, it is not necessary to align the writing electrodes of the writing heads with the image carriers when the frame is installed to the body frame of the image forming apparatus, thereby easily and precisely mounting the writing heads and the image carriers to the predetermined positions of the body frame of the full-color image forming apparatus.

In the state that the transfer voltage is continuously applied to the transfer member, the transfer member is in contact with the chargeable layer of the image carrier during a period after the previous paper is sent off before the next paper reaches and the non-image area of the intermediate transfer medium comes in contact with the image carrier. Since both the transfer voltage to be applied to the writing electrodes and the intermediate transfer voltage to be applied to the intermediate transfer medium are set to be equal to or lower than the maximum voltage to be applied to the writing electrodes, reverse charge injection from the transfer member or the intermediate transfer medium onto the image carrier never occurs. Therefore, the current flowing to the writing electrodes never exceed the withstand voltage of the high-voltage IC drivers connected to the writing electrodes. Therefore, similarly to the aforementioned case, this prevents the writing head from being broken, prevents the production of ghost image, and further inhibits voltage drop due to discharge between the image carrier and the writing electrodes during the process of writing a latent image, thereby preventing the electrostatic latent image from being in disorder. Even when the transfer voltage is increased for conducting the transfer in the environment of low-temperature and low-humidity (LL), the IC drivers of the writing electrodes can be prevented from being broken.

Since the reverse charge injection never occurs at the transfer portion, an electric potential difference exceeding the discharge starting voltage does not exist when the writing electrodes and the image carrier are in contact with each other. Production of vibration of the writing electrodes can be therefore prevented in spite of the frequency of ON/OFF signals applied to the writing electrodes. Accordingly, the contact between the writing electrodes and the image carrier can be stabilized, thereby obtaining excellent reproducibility of latent images.

The transfer member shifting mechanism biases the transfer member against said chargeable layer to bring the recording medium or the intermediate transfer medium into contact with the chargeable layer when the operation of transferring the developer image on the image carrier to the recording medium or the intermediate transfer medium is conducted. On the other hand, the transfer member shifting mechanism separates the transfer member from the chargeable layer of the image carrier or the intermediate transfer medium when the operation of transferring the developer image on the image carrier to the recording medium or the intermediate transfer medium is not conducted. That is, when neither a recording medium such as a paper nor a non-image area of the intermediate transfer medium exists between the image carrier and the transfer member, that is, when transfer operation is not conducted before the start of the transfer operation, after the finish of the transfer operation, or in an interval between the printed recording medium and the next recording medium in case of successively printing images on a predetermined number of recording media, the transfer member can be spaced apart from the chargeable layer of the image carrier or the intermediate transfer medium.

Therefore, the reverse charge injection from the non-image area of the transfer member or the intermediate transfer medium to the image carrier never occurs when operation of transferring the developer image on the image carrier to the recording medium or the intermediate transfer medium is not conducted and the current exceeding the withstand voltage of the IC drivers never flows to the writing electrodes, thereby preventing the writing head from being broken, prevents the production of ghost image, and further inhibits voltage drop due to discharge between the image carrier and the writing electrodes during the process of writing a latent image so as to prevent the electrostatic latent image from being in disorder. Even when the transfer voltage is increased for conducting the transfer in the environment of low-temperature and low-humidity (LL), the IC drivers of the writing electrodes can be prevented from being broken.

Since the reverse charge injection never occurs at the transfer portion, an electric potential difference exceeding the discharge starting voltage does not exist when the writing electrodes and the image carrier are in contact with each other. Production of vibration of the writing electrodes due to static electricity can be therefore prevented in spite of the frequency of ON/OFF signals applied to the writing electrodes. Accordingly, the contact between the writing electrodes and the image carrier can be stabilized, thereby obtaining excellent reproducibility of latent images.

Further, the surface potential adjusting member to which a predetermined voltage including 0 (zero) V is applied is disposed to be in contact with the chargeable layer between the writing electrodes and the transfer member and adjusts the voltage of said chargeable layer at the portion to be in contact with said writing electrodes similarly to the aforementioned case. By the surface potential adjusting member, the potential of the chargeable layer at the portion to be in contact with the writing electrodes is further reliably adjusted not to exceed the withstand voltage of the IC drivers of the writing electrodes.

Since the potential of the chargeable layer at the portion to be in contact with the writing electrodes never exceeds the withstand voltage of the IC drivers, an electric potential difference exceeding the discharge starting voltage does not exist when the writing electrodes and the image carrier are in contact with each other. Similarly to the above case, production of vibration of the writing electrodes can be therefore securely prevented.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DESCRIPTION OF THE PREFERRED EMBODIMENTS

Embodiments of the present invention will be described hereinafter with reference to the drawings.

Figure 1:
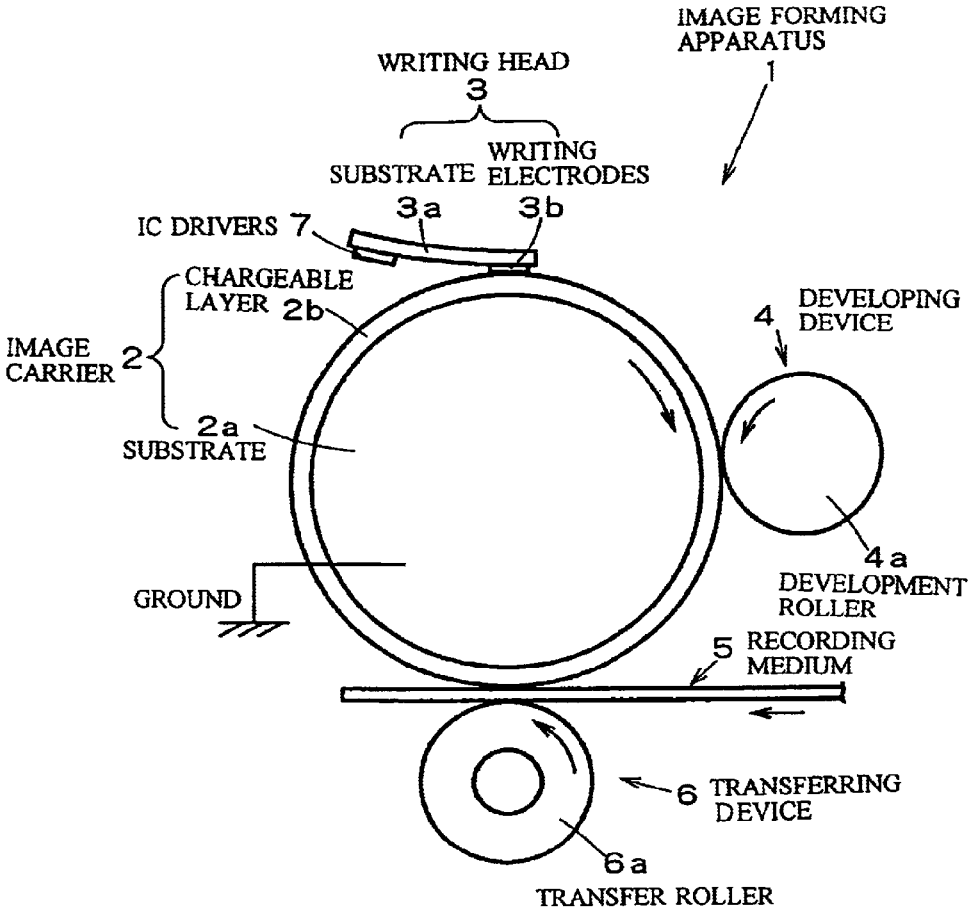
FIG. 1 is an illustration schematically showing the basic structure of an image forming apparatus proposed in Japanese Patent Application No. 2001-227630.
Figure 2:
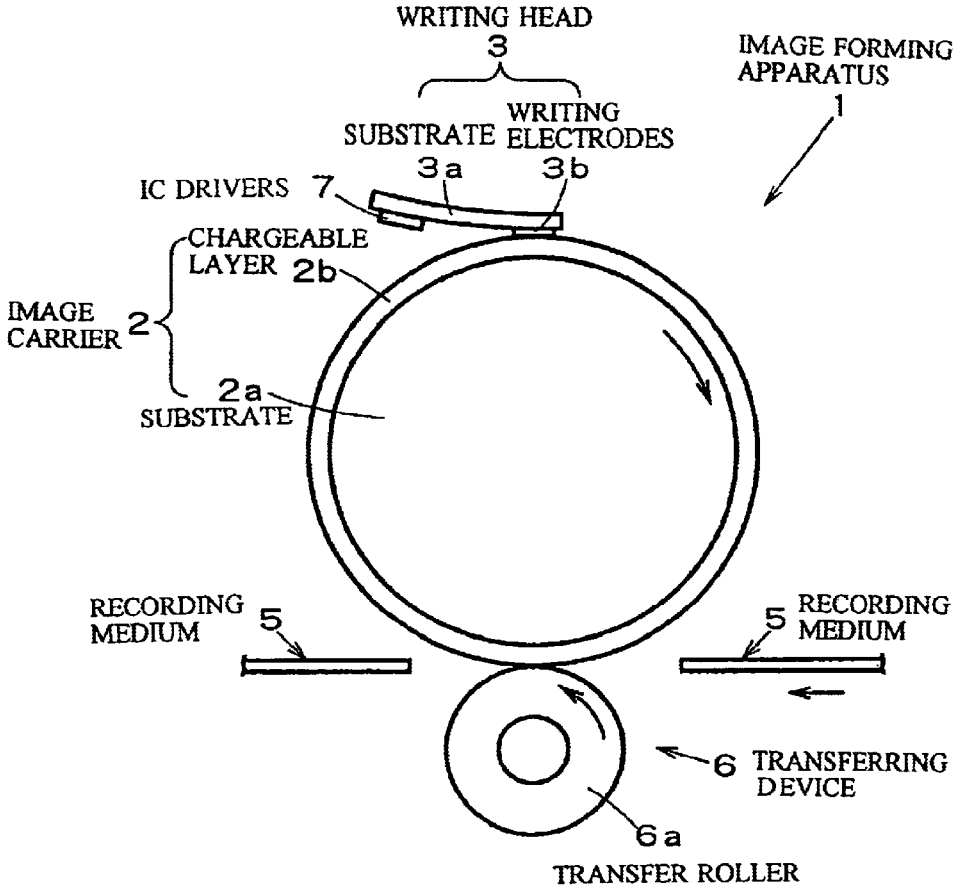
FIG. 2 is an illustration for explaining the behavior of the image forming apparatus shown in FIG. 1.
Figure 3A:
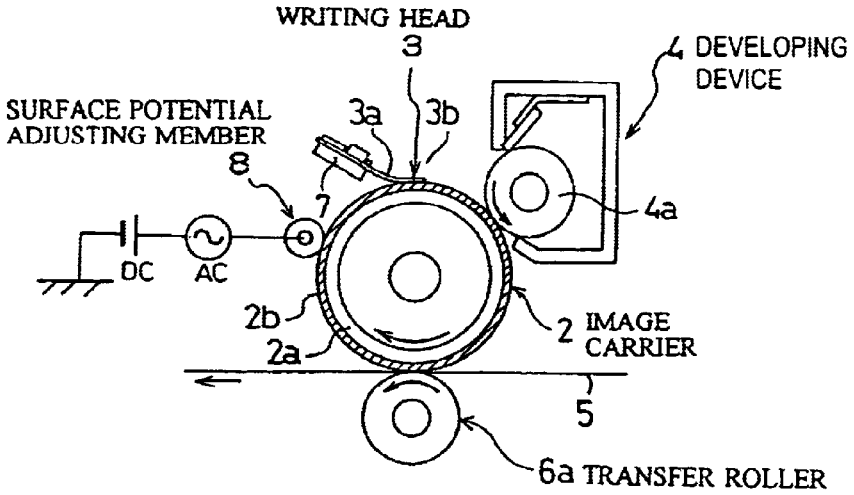
FIGS. 3(*a*) and 3(*b*) show a first embodiment of the image forming apparatus according to the present invention, wherein FIG. 3(*a*) is an illustration similar to FIG. 1, schematically showing the basic structure of the image forming apparatus of the first embodiment and FIG. 3(*b*) is a perspective view partially showing the image forming apparatus shown in FIG. 3(*a*)
Figure 3B:
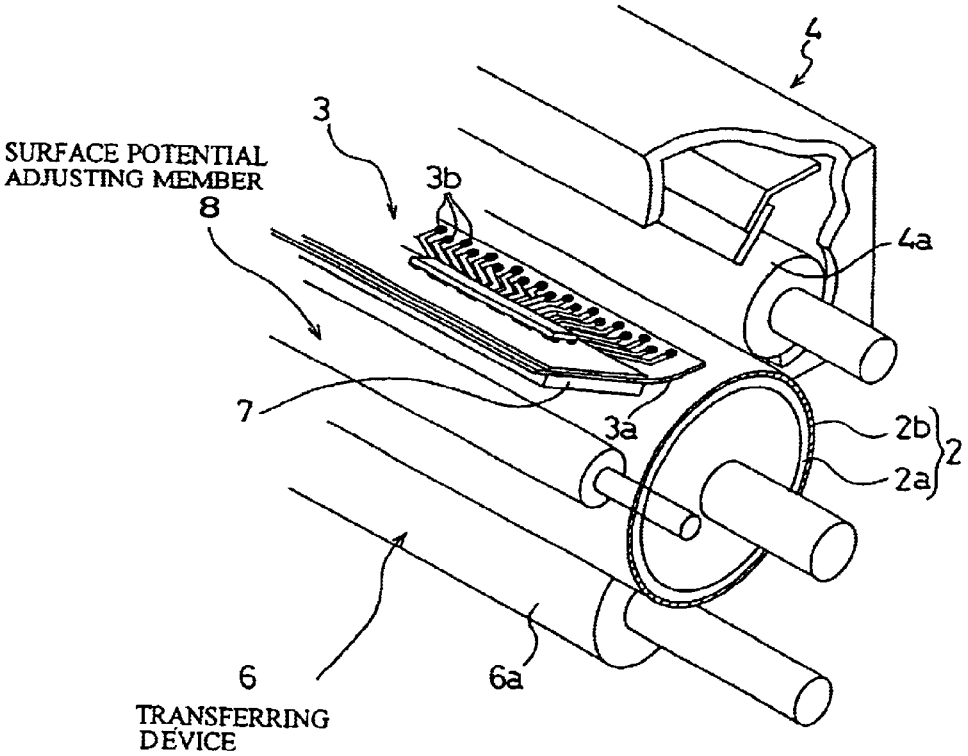

FIGS. 3(*a*) and 3(*b*) show a first embodiment of the image forming apparatus according to the present invention, wherein FIG. 3(*a*) is an illustration similar to FIG. 1, schematically showing the basic structure of the image forming apparatus of the first embodiment and FIG. 3(*b*) is a perspective view partially showing the image forming apparatus shown in FIG. 3(*a*). It should be noted that, in the following description, component parts similar or corresponding to parts of any example previously described (including the image forming apparatus proposed in the '630 application) will be designated with the same reference numerals and the detail description of such component parts will be therefore omitted.

An image forming apparatus of the first embodiment basically comprises the same components of the aforementioned image forming apparatus proposed in the '630 application shown in FIG. 1 and further comprises a surface potential adjusting member 8 between the writing electrodes 3*b* and the transfer roller 6*a* as shown in FIGS. 3(*a*) and 3(*b*). As more concretely described, the surface potential adjusting member 8 is positioned downstream of the contact portion of the chargeable layer 2*b* of the image carrier 2 with the transfer roller 6*a* in the rotational direction of the image carrier 2 and upstream of the contact portion of the chargeable layer 2*b* of the image carrier 2 with the writing electrodes 3*b* of the writing head 3 in the rotational direction of the image carrier 2. The surface potential adjusting member 8 is arranged to be in contact with the chargeable layer 2*b* of the image carrier 2. The surface potential adjusting member 8 is set to rotate to have a predetermined peripheral surface speed ratio relative to the image carrier 2.

A surface potential adjusting bias voltage composed of an alternating current (AC) voltage superimposed on a direct current (DC) voltage is applied to the surface potential adjusting member 8, whereby the surface potential adjusting member 8 adjusts the voltage at a portion of the chargeable layer 2*b* of the image carrier 2 where the writing electrodes 3*b* are in contact with. It should be noted that the surface potential adjusting bias voltage may be composed of only a DC voltage. The DC voltage of the surface potential adjusting bias voltage is set to a predetermined voltage including 0 (zero) V. The value of the DC voltage is preferably set to be the same as the value of the latent image forming bias voltage applied to the image carrier 2. In the illustrated embodiment, the image carrier 2 is grounded so that a DC voltage of 0 (zero) V is applied to the image carrier 2.

The surface potential adjusting member 8 has a cleaning function, thereby removing objects such as residual developer remaining on the image carrier 2 after transfer.

As the surface potential adjusting member 8, a rotatable conductive roller such as a conductive fur brush, a conductive rubber roller, or a conductive magnetic brush may be employed.

Further, in the image forming apparatus 1 of the first embodiment, the timing for conducting the application of voltages after the start of image forming is set as follows. Among the application of the latent image forming bias voltage to the image carrier 2, the application of the writing voltage to the writing electrodes 3*b*, the application of the developing bias voltage to the development roller 4*a*, the application of the transfer bias voltage to the transfer roller 6*a*, and the application of the surface potential adjusting bias voltage to the surface potential adjusting member 8, the application of the voltage to the surface potential adjusting member 8 is first conducted for removing charge of the chargeable layer 2*b* of the image carrier 2.

On the other hand, the timing for stopping the application of voltages after the finish of the image forming process is set as follows. Among the application of the latent image forming bias voltage to the image carrier 2, the application of the writing voltage to the writing electrodes 3*b*, the application of the developing bias voltage to the development roller 4*a*, the application of the transfer bias voltage to the transfer roller 6*a*, and the application of the surface potential adjusting bias voltage to the surface potential adjusting member 8, the application of voltage to the surface potential adjusting member 8 is last stopped for removing charge of the chargeable layer 2*b* of the image carrier 2.

The other structure of the image forming apparatus 1 of the first embodiment is the same as that of the aforementioned image forming apparatus 1 of the '630 application shown in FIG. 1.

In the image forming apparatus 1 of the first embodiment structured as mentioned above, similarly to the aforementioned image forming apparatus 1 of the '630 application shown in FIG. 1, after the chargeable layer 2*b* of the image carrier 2 is made into the uniformly charged state, writing voltage is applied to the writing electrodes 3*b* so that an electrostatic latent image is written on the chargeable layer 2*b* of the image carrier 2 mainly via the contact-charge transfer between image carrier 2 and the writing electrodes 3*b* of the writing head 3 which are in plane contact with each other. The electrostatic latent image on the chargeable layer 2*b* of the image carrier 2 is then developed with developer carried by the development roller 4*a* of the developing device 4 to form a developer image and the developer image is transferred to a paper by the transfer roller 6*a* to which transfer voltage is applied.

According to the image forming apparatus 1 of the first embodiment, the voltage of the chargeable layer 2*b* at the portion to be in contact with the writing electrodes 3*b* a is adjusted by the surface potential adjusting member 8 which is arranged in contact with the chargeable layer 2*b* of the image carrier 2 between the writing electrodes 3*b* and the transfer roller 6*a*. When the transfer roller 6*a* is in contact with the chargeable layer 2*b* of the image carrier 2 in the state that the transfer voltage is applied to the transfer roller 6*a* during a period after the previous paper 5 is sent off before the next paper 5 reaches, reverse charge injection from the transfer roller 6*a* onto the chargeable layer 2*b* of the image carrier 2 may occur. Even if the reverse charge injection occurs, the potential of the chargeable layer 2*b* at its portion to be in contact with the writing electrodes 3*b* is adjusted not to exceed the withstand voltage of the IC drivers 7 of the writing electrodes 3*b* by the surface potential adjusting member 8.

Therefore, this prevents the writing electrodes 3*b* and the IC drivers 7 of the writing head 3 from being broken, prevents the production of ghost image, and further inhibits voltage drop due to discharge between the image carrier 2 and the writing electrodes 3*b* during the process of writing a latent image, thereby preventing the electrostatic latent image from being in disorder.

Even when the transfer voltage is increased for conducting the transfer in the environment of low-temperature and low-humidity (LL), the IC drivers 7 of the writing electrodes 3*b* can be prevented from being broken.

Since the potential of the chargeable layer 2*b* at its portion to be in contact with the writing electrodes 3*b* is adjusted not to exceed the withstand voltage of the IC drivers 7, an electric potential difference exceeding the discharge starting voltage does not exist when the writing electrodes 3*b* and the image carrier 2 are in contact with each other. Production of vibration due to static electricity can be prevented in spite of the frequency of ON/OFF signals applied to the writing electrodes 3*b*. Accordingly, the contact between the writing electrodes 3*b* and the image carrier 2 can be stabilized, thereby obtaining excellent reproducibility of latent images.

The surface potential adjusting member 8 has a predetermined peripheral surface speed ratio relative to the image carrier 2, thus improving the potential adjustment of the chargeable layer 2*b*. In addition, the surface potential adjusting member 8 is composed of a rotatable conductive roller such as a conductive fur brush, a conductive rubber roller, or a conductive magnetic brush so as to increase the situation where the conductive roller is in contact with the image carrier 2, thereby further improving the potential adjustment of the chargeable layer 2*b*. By designing the conductive roller to be in elastically contact with the image carrier 2, the contact ability is improved, further improving the potential adjustment of the chargeable layer 2*b*.

Since the surface potential adjusting member 8 has a cleaning function, the residual developer remaining on the image carrier 2 after transfer can be removed by the surface potential adjusting member 8. If residual developer remains adhering to the image carrier 2 and the peripheral surface speed ratio between the surface potential adjusting member 8 and the image carrier 2 is 1, the potential of the chargeable layer 2*b* may be insufficiently adjusted. However, the residual developer on the image carrier 2 can be surely removed because of the cleaning function, thereby ensuring the potential adjustment of the chargeable layer 2*b* and preventing developer from adhering to the writing electrodes 3*b*.

The surface potential adjusting bias voltage to be applied to the surface potential adjusting member 8 is set to a voltage composed of an AC voltage having a suitable frequency superimposed on a direct current set as a reference voltage (ground reference voltage) to be applied to the image carrier 2, thereby efficiently collecting negatively charged residual developer remaining on the image carrier 2 after transfer and securely adjusting the surface potential of the chargeable layer 2*b* of the image carrier 2 to the reference bias voltage (for example, the ground reference voltage).

Among the application of the latent image forming bias voltage to the image carrier 2, the application of the writing voltage to the writing electrodes 3*b*, the application of the developing bias voltage to the development roller 4*a*, the application of the transfer bias voltage to the transfer roller 6*a*, and the application of the surface potential adjusting bias voltage to the surface potential adjusting member 8, the application of the voltage to the surface potential adjusting member 8 is first conducted for removing charge of the chargeable layer 2*b* of the image carrier 2, whereby the surface potential of the chargeable layer 2*b* of the image carrier 2 can be securely adjusted to the reference bias voltage (for example, ground reference voltage).

On the other hand, the timing for stopping the application of voltages after the finish of the image forming process is set as follows. Among the application of the latent image forming bias voltage to the image carrier 2, the application of the writing voltage to the writing electrodes 3*b*, the application of the developing bias voltage to the development roller 4*a*, the application of the transfer bias voltage to the transfer roller 6*a*, and the application of the surface potential adjusting bias voltage to the surface potential adjusting member 8, the application of voltage to the surface potential adjusting member 8 is last stopped for removing charge of the chargeable layer 2*b* of the image carrier 2, whereby the surface potential of the chargeable layer 2*b* of the image carrier 2 can be securely adjusted to the reference bias voltage (for example, ground reference voltage).

The other works and effects of the image forming apparatus 1 of the first embodiment are the same as those of the image forming apparatus 1 of the '630 application shown in FIG. 1.

Figure 4:
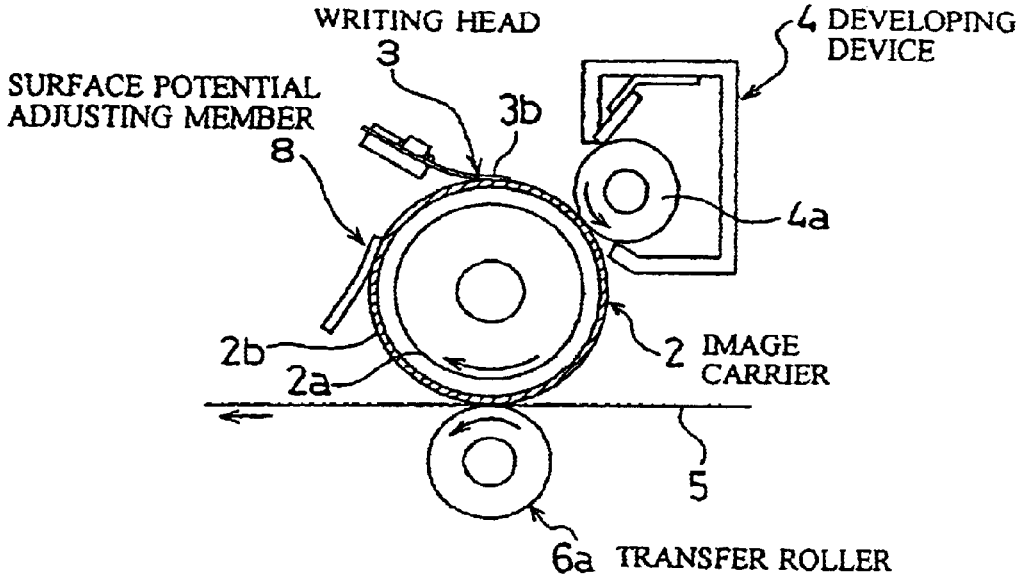
FIG. 4 is an illustration similar to FIG. 3(*a*), schematically showing the basic structure of a second embodiment of the image forming apparatus according to the present invention.

FIG. 4 is an illustration similar to FIG. 3(*a*), schematically showing the basic structure of a second embodiment of the image forming apparatus according to the present invention.

Though the surface potential adjusting member 8 is composed of a rotatable member such as a rotatable conductive roller in the aforementioned first embodiment shown in FIGS. 3(*a*), 3(*b*), the surface potential adjusting member 8 is composed of a plate member fixed to a frame (not shown) as shown in FIG. 4 in the image forming apparatus 1 of the second embodiment.

The works and effects of the image forming apparatus 1 of the second embodiment are the same as those of the image forming apparatus 1 of the first embodiment shown in FIGS. 3(*a*), 3(*b*), except that the surface potential adjusting member 8 is fixed to the frame.

Figure 5:
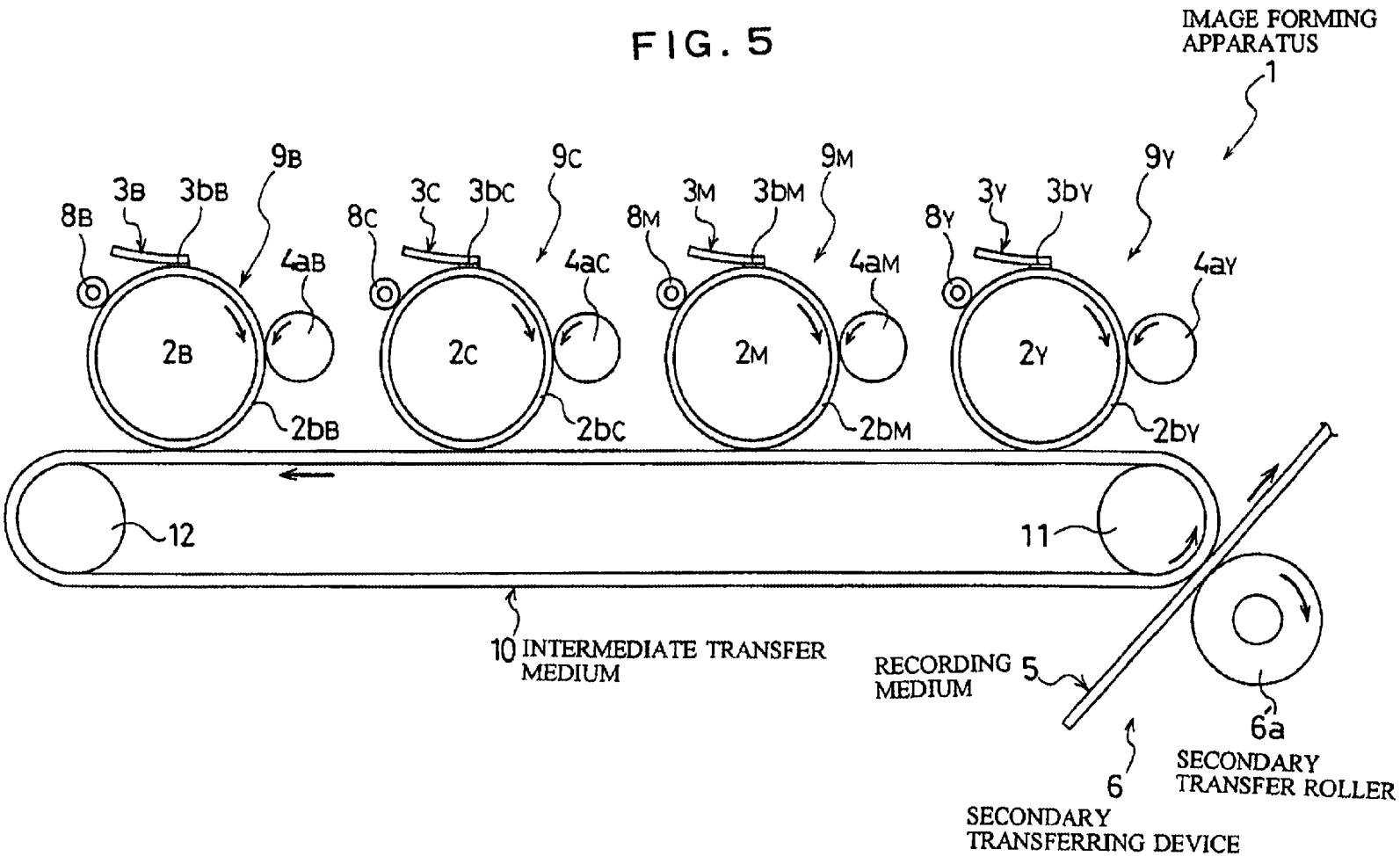
FIG. 5 is an illustration schematically showing a full-color image forming apparatus made up of a combination of plural image forming apparatuses shown in FIGS. 3(*a*), 3(*b*) of the first embodiment according to the present invention.

FIG. 5 is an illustration schematically showing a full-color image forming apparatus employing image forming apparatuses 1 of the first embodiment shown in FIGS. 3(*a*), 3(*b*).

Among the components of the image forming apparatus 1, the writing head 3, the developing device 4, the image carrier 2, and the surface potential adjusting member 8 make up an image carrier unit 9 as shown in FIG. 5. The image forming apparatus 1 of this embodiment comprises such image carrier units $\mathbf{9}_Y$, $\mathbf{9}_M$, $\mathbf{9}_C$, $\mathbf{9}_B$ which are provided for four colors of yellow Y, magenta M, cyan C, and black B, respectively.

Each image carrier unit $\mathbf{9}_Y$, $\mathbf{9}_M$, $\mathbf{9}_C$, $\mathbf{9}_B$ comprises an image carrier $\mathbf{2}_Y$, $\mathbf{2}_M$, $\mathbf{2}_C$, $\mathbf{2}_B$, a writing head $\mathbf{3}_Y$, $\mathbf{3}_M$, $\mathbf{3}_C$, $\mathbf{3}_B$ provided with writing electrodes $\mathbf{3}b_Y$, $\mathbf{3}b_M$, $\mathbf{3}b_C$, $\mathbf{3}b_B$, a development roller $\mathbf{4}a_Y$, $\mathbf{4}a_M$, $\mathbf{4}a_C$, $\mathbf{4}a_B$, and a surface potential adjusting member $\mathbf{8}_Y$, $\mathbf{8}_M$, $\mathbf{8}_c$, $\mathbf{8}_B$ for the corresponding color, i.e. yellow Y, magenta M, cyan C, or black B.

The image forming apparatus 1 of this embodiment further comprises an intermediate transfer medium 10 and a secondary transferring device 6 which are common to the four colors. The image carrier units $\mathbf{9}_Y$, $\mathbf{9}_M$, $\mathbf{9}_C$, $\mathbf{9}_B$ are arranged in tandem in this order from the upstream in the rotational direction of the intermediate transfer medium 10 (the counterclockwise direction in FIG. 5). It should be understood that the image carrier units may be arranged in any order.

The intermediate transfer medium 10 in an endless belt shape is wound onto and tightly held by a driving roller 11 and a driven roller 12 and is driven to circulate by the driving roller 11 driven by a motor (not shown). By passing a paper (recording medium) 5 between the intermediate transfer medium 10 and the secondary transfer roller 6*a* at the position of the driving roller 11 with some pressure, the secondary transfer onto the paper 5 is carried out.

In the full-color image forming apparatus 1 of this embodiment, the surface potential adjusting members $\mathbf{8}_Y$, $\mathbf{8}_M$, $\mathbf{8}_C$, $\mathbf{8}_B$ are independently controlled to adjust the potential of portions of the chargeable layers $\mathbf{2}by$, $\mathbf{2}b_M$, $\mathbf{2}b_C$, $\mathbf{2}b_B$ of the corresponding image carriers $\mathbf{2}_Y$, $\mathbf{2}_M$, $\mathbf{2}_C$, $\mathbf{2}_B$ where the writing electrodes $\mathbf{3}b_Y$, $\mathbf{3}b_M$, $\mathbf{3}b_C$, $\mathbf{3}b_B$ are in contact with, respectively.

The other works and effects of the full-color image forming apparatus 1 of this embodiment are the same as those of the aforementioned image forming apparatus 1 of the first embodiment shown in FIGS. 3(*a*), 3(*b*).

Figure 6:
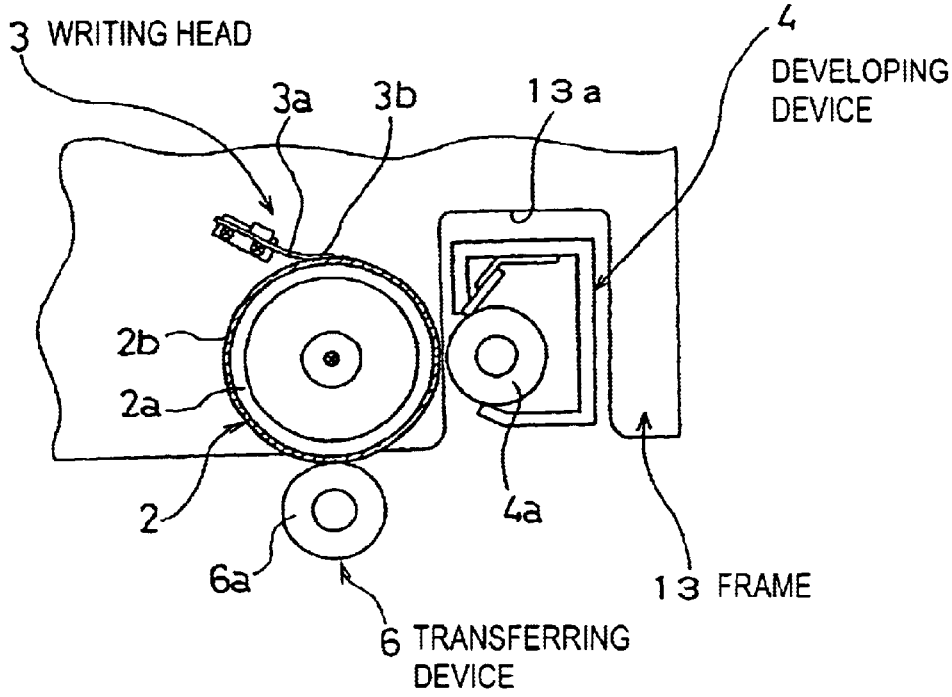
FIG. 6 is an illustration schematically showing the basic structure of a third embodiment of the image forming apparatus according to the present invention.

FIG. 6 is an illustration schematically showing the basic structure of a third embodiment of the image forming apparatus according to the present invention.

As shown in FIG. 6, the image forming apparatus of the third embodiment basically comprises the same components of the aforementioned image forming apparatus 1 proposed in the '630 application. In the image forming apparatus 1 of the third embodiment, the image carrier 2 and the writing head 3 are positioned and attached to a common frame 13 not to shift their relative positions so that they are installed as an integral member. Since the image carrier 2 and the writing head 3 are positioned as mentioned above, the writing electrodes 3*b* of the writing head 3 can be in contact with the image carrier 2 with a constant pressure. The frame 13 has a cutoff concave portion 13*a* for receiving the developing device 4.

The frame 13 to which the image carrier 2 and the writing head 3 are attached is fixed to a body frame (not shown) of the image forming apparatus 1 to which the developing device 4 and the transferring device 6 are attached. The frame 13 is fixed to the body frame of the image forming apparatus 1 such that the developing device 4 is received in the cutoff concave portion 13*a* of the frame 13 and that the image carrier 2 is positioned to establish respective predetermined positions relative to the development roller 4*a* of the developing device 4 and relative to the transfer roller 6*a* of the transferring device 6.

The other structure of the image forming apparatus 1 of the third embodiment is the same as that of the aforementioned image forming apparatus 1 of the '630 application.

In the image forming apparatus 1 of the third embodiment structured as mentioned above, similarly to the aforementioned image forming apparatus 1 of the '630 application shown in FIG. 1, after the chargeable layer 2*b* of the image carrier 2 is made into the uniformly charged state, an electrostatic latent image is written on the chargeable layer 2*b* of the image carrier 2 mainly via the contact-charge transfer between the chargeable layer 2*b* of the image carrier 2 and the writing electrodes 3*b* of the writing head 3 which are in contact with each other. Since the writing head 3 and the image carrier 2 are fixed to the common frame 13, their relative positions never be shifted and the electrostatic latent image is thus securely written on the predetermined position of the chargeable layer 2*b* by the writing electrodes 3*b*. The electrostatic latent image on the chargeable layer 2*b* of the image carrier 2 is then developed with developer carried by the development roller 4*a* of the developing device 4 to form a developer image and the developer image is transferred to a paper 5 by the transfer roller 6*a* of the transferring device 6.

According to the image forming apparatus 1 of the third embodiment, the stable writing of electrostatic latent image is achieved because of plane contact of the writing electrodes 3*b* with the chargeable layer 2*b* similar to the aforementioned image forming apparatus 1 of the '630 application.

The writing head 3 and the image carrier 2 are previously positioned and fixed to the common frame 13, thereby making it possible to precisely set the writing position of latent image to be written by the writing electrodes 3*b* and making the contact pressure of the writing electrodes to the image carrier constant.

Therefore, this prevents the latent image and its developer image from being in disorder, stabilizes the charging and discharging speed i.e. the latent image forming speed, and improve the latent image forming stability. Accordingly, the image forming apparatus 1 of this embodiment can stably provide high-quality images.

Since the writing head 3 and the image carrier 2 are previously fixed to the common frame 13, it is not necessary to align the writing electrodes 3*b* with the image carrier 2 when installed to the body frame of the image forming apparatus 1, thereby easily and precisely mounting the writing head 3 and the image carrier 2 to the predetermined position of the body frame of the image forming apparatus 1.

The other works and effects of the image forming apparatus 1 of the third embodiment are the same as those of the aforementioned image forming apparatus 1 of the '630 application.

Figure 7A:
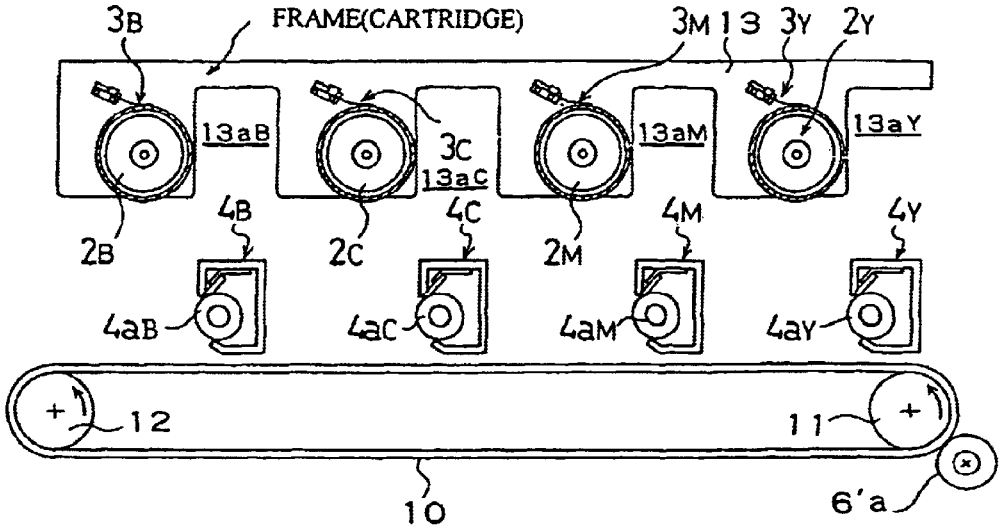
FIGS. 7(*a*) and 7(*b*) schematically show an example of a full-color image forming apparatus employing image forming apparatuses of the third embodiments in which pairs of writing heads and image carriers are attached to a common frame not to shift their relative positions, wherein FIG. 7(*a*) is an illustration showing a state where the frame having the writing heads and the image carriers attached thereto is removed from a body frame of the image forming apparatus and FIG. 7(*b*) is an illustration showing the state where the frame having the writing heads and the image carriers attached thereto is installed to the body frame of the image forming apparatus
Figure 7B:
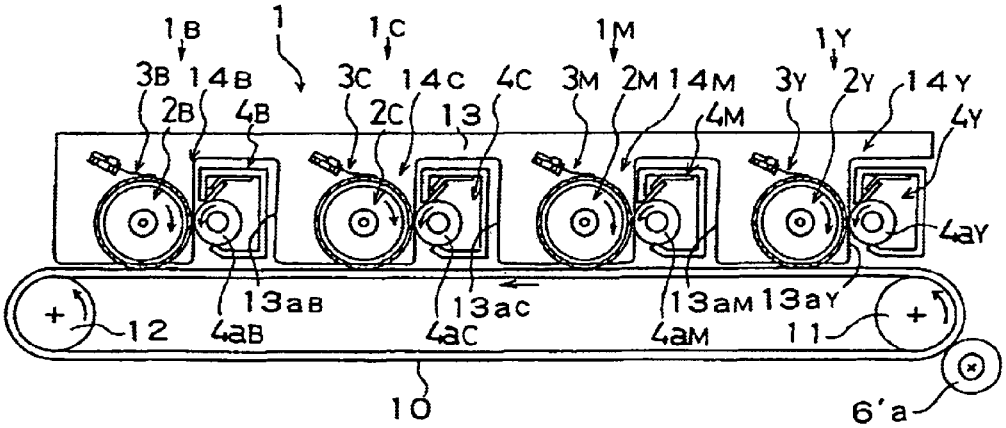

FIGS. 7(*a*) and 7(*b*) schematically show an example of a full-color image forming apparatus employing image forming apparatuses 1 of the third embodiment in which pairs of writing heads and image carriers are attached to a common frame not to shift their relative positions, wherein FIG. 7(*a*) is an illustration showing a state where the frame having the writing heads and the image carriers attached thereto is removed from a body frame of the image forming apparatus and FIG. 7(*b*) is an illustration showing the state where the frame having the writing heads and the image carriers attached thereto is installed to the body frame of the image forming apparatus.

As shown in FIGS. 7(*a*) and 7(*b*), the full-color image forming apparatus 1 comprises an yellow image forming unit $\mathbf{14}_Y$, a magenta image forming unit $\mathbf{14}_M$, a cyan image forming unit $\mathbf{14}_C$, and a black image forming unit $\mathbf{14}_B$ which are positioned and arranged in tandem in this order from the upstream in the rotational direction of a belt-like intermediate transfer medium 10. The yellow image forming unit $\mathbf{14}_Y$ comprises a writing head $\mathbf{3}_Y$ and an image carrier $\mathbf{2}_Y$ for yellow Y which are attached to the frame 13 not to shift their relative positions. The magenta image forming unit $\mathbf{14}_M$ comprises a writing head $\mathbf{3}_M$ and an image carrier $\mathbf{2}_M$ for magenta M which are attached to the frame 13 not to shift their relative positions. The cyan image forming unit $\mathbf{14}_C$ comprises a writing head $\mathbf{3}_C$ and an image carrier $\mathbf{2}_C$ for cyan C which are attached to the frame 13 not to shift their relative positions. The black image forming unit $\mathbf{14}_B$ comprises a writing head $\mathbf{3}_B$ and an image carrier $\mathbf{2}_B$ for black B which are attached to the frame 13 not to shift their relative positions.

That is, in the full-color image forming apparatus 1 of this embodiment, the writing heads $\mathbf{3}_Y$, $\mathbf{3}_M$, $\mathbf{3}_C$, $\mathbf{3}_B$ and the image carriers $\mathbf{2}_Y$, $\mathbf{2}_M$, $\mathbf{2}_C$, $\mathbf{2}_B$ for the respective colors are previously positioned and fixed to the common frame 13 not to shift their relative positions.

As the frame 13 with the writing heads $\mathbf{3}_Y$, $\mathbf{3}_M$, $\mathbf{3}_C$, $\mathbf{3}_B$ and the image carriers $\mathbf{2}_Y$, $\mathbf{2}_M$, $\mathbf{2}_C$, $\mathbf{2}_B$ for the respective colors attached thereto is installed to the body frame of the full-color image forming apparatus 1 as shown in FIG. 7(*b*), the developing devices $\mathbf{4}_Y$, $\mathbf{4}_M$, $\mathbf{4}_C$, $\mathbf{4}_B$ for the respective colors are received in the corresponding cutoff concave portions $\mathbf{13}a_Y$, $\mathbf{13}a_M$, $\mathbf{13}a_C$, $\mathbf{13}a_B$ of the frame 13 and the image carriers $\mathbf{2}_Y$, $\mathbf{2}_M$, $\mathbf{2}_C$, $\mathbf{2}_B$ for the respective colors are arranged to establish the respective predetermined positions relative to the development rollers $\mathbf{4}a_Y$, $\mathbf{4}a_M$, $\mathbf{4}a_C$, $\mathbf{4}a_B$ of the developing devices $\mathbf{4}_Y$, $\mathbf{4}_M$, $\mathbf{4}_C$, $\mathbf{4}_B$ and relative to the intermediate transfer medium 10. The intermediate transfer medium 10 is driven to circulate in the counterclockwise direction in the drawing by a driving roller 11 which is driven by a motor (not shown) similarly to the aforementioned embodiment. A transfer roller 6'*a* of a secondary transferring device 6' is arranged to move apart and come in contact with the intermediate transfer medium 10.

In the full-color image forming apparatus 1 of this embodiment structured as mentioned above, the image forming unit $\mathbf{1}_Y$ for yellow Y is first operated as follows. After the surface of the image carrier $\mathbf{2}_Y$ for yellow Y is made into the uniformly charged state, an electrostatic latent image for yellow Y is written on the surface of the image carrier $\mathbf{2}_Y$ mainly via the contact-charge transfer between image carrier $\mathbf{2}_Y$ and the writing electrodes of the writing head $\mathbf{3}_Y$. The electrostatic latent image for yellow Y is then developed with yellow developer carried by the development roller $\mathbf{4}a_Y$ of the developing device $\mathbf{4}_Y$ to form a developer image for yellow Y. The developer image for yellow Y on the image carrier $\mathbf{2}_Y$ is transferred to the intermediate transfer medium 10 so as to form a developer image for yellow Y on the intermediate transfer medium 10.

The image forming unit $\mathbf{1}_M$ for magenta M is then operated as follows. After the surface of the image carrier $\mathbf{2}_M$ for magenta M is made into the uniformly charged state, an electrostatic latent image for magenta M is written on the surface of the image carrier $\mathbf{2}_M$ mainly via the contact-charge transfer between image carrier $\mathbf{2}_M$ and the writing electrodes of the writing head $\mathbf{3}_M$. The electrostatic latent image for magenta M is then developed with magenta developer carried by the development roller $\mathbf{4}a_M$ of the developing device $\mathbf{4}_M$ to form a developer image for magenta M. The developer image for magenta M on the image carrier $\mathbf{2}_M$ is transferred to be superposed on the developer image for yellow Y on the intermediate transfer medium 10 so as to form a developer image for magenta M on the intermediate transfer medium 10.

In the same manner, an electrostatic latent image for cyan C is subsequently written on the image carrier $\mathbf{2}_C$ for cyan C mainly via the contact-charge transfer between the image carrier $\mathbf{2}_C$ and the writing electrodes of the writing head $\mathbf{3}_C$ for cyan C, the electrostatic latent image is developed with cyan developer carried by the development roller $\mathbf{4}a_C$ of the developing device $\mathbf{4}_C$ for cyan C to form a developer image for cyan C, and the developer image is transferred to be superposed on the developer images for yellow Y and magenta M on the intermediate transfer medium 10. An electrostatic latent image for black B is subsequently written on the image carrier $\mathbf{2}_B$ for black B mainly via the contact-charge transfer between the image carrier $\mathbf{2}_B$ and the writing electrodes of the writing head $\mathbf{3}_B$ for black B, the electrostatic latent image is developed with black developer carried by the development roller $\mathbf{4}a_B$ of the developing device $\mathbf{4}_B$ for black B to form a developer image for black B, and the developer image is transferred to be superposed on the developer images for yellow Y, for magenta M, and for cyan C on the intermediate transfer medium 10, thereby superposing the developer images for the respective colors to produce a toned full-color developer image on the intermediate transfer medium 10. Since the writing heads $\mathbf{3}_Y$, $\mathbf{3}_M$, $\mathbf{3}_C$, $\mathbf{3}_B$ and the image carriers $\mathbf{2}_Y$, $\mathbf{2}_M$, $\mathbf{2}_C$, $\mathbf{2}_B$ are fixed to the common frame 13, their relative positions never be shifted and the electrostatic latent images are thus securely written on the predetermined positions of the image carriers $\mathbf{2}_Y$, $\mathbf{2}_M$, $\mathbf{2}_C$, $\mathbf{3}_B$ for the respective colors by the writing electrodes of the writing heads $\mathbf{3}_Y$, $\mathbf{3}_M$, $\mathbf{3}_C$, $\mathbf{3}_B$ for the respective colors. It should be understood that the developer images for the respective colors may be formed in any order other than the aforementioned order.

The full-color developer image on the intermediate transfer medium 10 is secondarily transferred to a paper 5 (not shown) by the secondary transfer roller 6'*a* of the secondary transfer device and the full-color developer image is subsequently fixed on the paper 5 by a known fixing device (not shown), thereby forming a full-color image on the paper 5.

As described above, according to the full-color image forming apparatus 1 of the third embodiment, the stable writing of electrostatic latent images is achieved because of plane contact of the writing electrodes of the writing heads $\mathbf{3}_Y$, $\mathbf{3}_M$, $\mathbf{3}_C$, $\mathbf{3}_B$ with the chargeable layers of the image carriers $\mathbf{2}_Y$, $\mathbf{2}_M$, $\mathbf{2}_C$, $\mathbf{2}_B$, respectively similar to the aforementioned embodiments.

The writing head $\mathbf{3}_Y$, $\mathbf{3}_M$, $\mathbf{3}_C$, $\mathbf{3}_B$ and the image carriers $\mathbf{2}_Y$, $\mathbf{2}_M$, $\mathbf{2}_C$, $\mathbf{2}_B$ are fixed to the common frame 13 to fix their relative positions, thereby making it possible to precisely set the writing positions of latent images to be written by the writing electrodes for the respective colors and making the respective contact pressures of the writing electrodes for the respective colors to the image carriers $\mathbf{2}_Y$, $\mathbf{2}_M$, $\mathbf{2}_C$, $\mathbf{2}_B$ constant.

Therefore, the full-color image forming apparatus 1 of this embodiment makes it possible to precisely tone the colors and position the latent images so as to provide high-quality images.

Since the writing heads $\mathbf{3}_Y$, $\mathbf{3}_M$, $\mathbf{3}_C$, $\mathbf{3}_B$ and the image carriers $\mathbf{2}_Y$, $\mathbf{2}_M$, $\mathbf{2}_C$, $\mathbf{3}_B$ are previously fixed to the common frame 13, it is not necessary to align the writing electrodes of the writing heads $\mathbf{3}_Y$, $\mathbf{3}_M$, $\mathbf{3}_C$, $\mathbf{3}_B$ with the image carriers $\mathbf{2}_Y$, $\mathbf{2}_M$, $\mathbf{2}_C$, $\mathbf{3}_B$ when the frame 13 is installed to the body frame of the image forming apparatus 1, thereby easily and precisely mounting the writing heads $\mathbf{3}_Y$, $\mathbf{3}_M$, $\mathbf{3}_C$, $\mathbf{3}_B$ and the image carriers $\mathbf{2}_Y$, $\mathbf{2}_M$, $\mathbf{2}_C$, $\mathbf{3}_B$ to the predetermined positions of the body frame of the full-color image forming apparatus.

Figure 8:
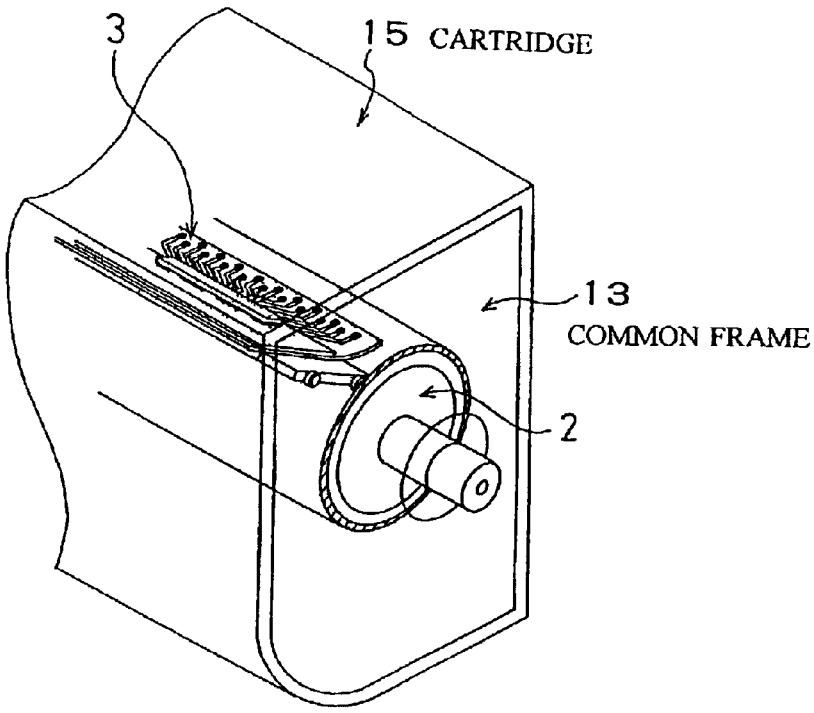
FIG. 8 is a perspective view partially showing a fourth embodiment of the image forming apparatus of the present invention.

FIG. 8 is a perspective view partially showing a fourth embodiment of the image forming apparatus of the present invention.

The image forming apparatus 1 of the fourth embodiment is the same as the third embodiment in FIG. 6 in that a writing head 3 and an image carrier 2 are positioned and fixed to a common frame 13, but is different from the third embodiment in that the writing head 3, the carrier 2, and the frame 13 are structured as one cartridge 15 as shown in FIG. 8.

According to the image forming apparatus 1 of the fourth embodiment, the writing head 3, the image carrier 2, and the frame 13 are structured as the cartridge 15, thus significantly facilitating the installation and the replacement of the writing head 3 and the image carrier 2 relative to the body frame of the image forming apparatus 1.

The other structure and the other works and effects of the image forming apparatus 1 of the fourth embodiment are the same as those of the aforementioned third embodiment shown in FIG. 6.

Figure 9:
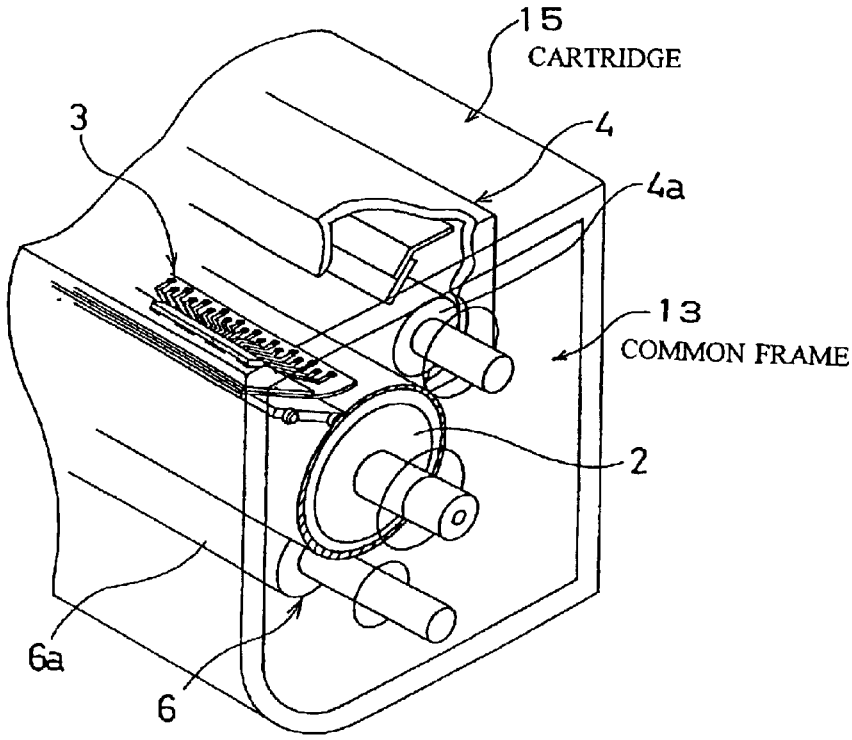
FIG. 9 is a perspective view partially showing a fifth embodiment of the image forming apparatus of the present invention.

FIG. 9 is a perspective view partially showing a fifth embodiment of the image forming apparatus of the present invention.

Though the writing head 3, the image carrier 2, and the frame 13 are structured as the cartridge 15 in the aforementioned fourth embodiment shown in FIG. 8, a developing device 4 and a transferring device 6 are also positioned and fixed to the frame 13 in addition to the writing head 3 and the image carrier 2 not to shift their respective positions and the image carrier 2, the writing head 3, the developing device 4, the transferring device 6, and the frame 13 are structured as one cartridge 15.

According to the image forming apparatus 1 of the fifth embodiment, the image carrier 2, the writing head 3, the developing device 4, and the transferring device 6 are positioned and fixed to the common frame 13, thereby still further precisely conducting the formation of images and providing higher quality images.

The image carrier 2, the writing head 3, the developing device 4, the transferring device 6, and the frame 13 are structured as one cartridge 15, thus significantly facilitating the installation and the replacement of the image carrier 2, the writing head 3, the developing device 4, and the transferring device 6 relative to the body frame of the image forming apparatus 1.

The other structure and the other works and effects of the image forming apparatus 1 of the fifth embodiment are the same as those of the aforementioned third embodiment shown in FIG. 6.

Though both the developing device 4 and the transferring device 6 are fixed to the common frame 13 in the fifth embodiment shown in FIG. 9, at least one of the developing device 4 and the transferring device 6 may be fixed to the common frame 13.

Figure 10:
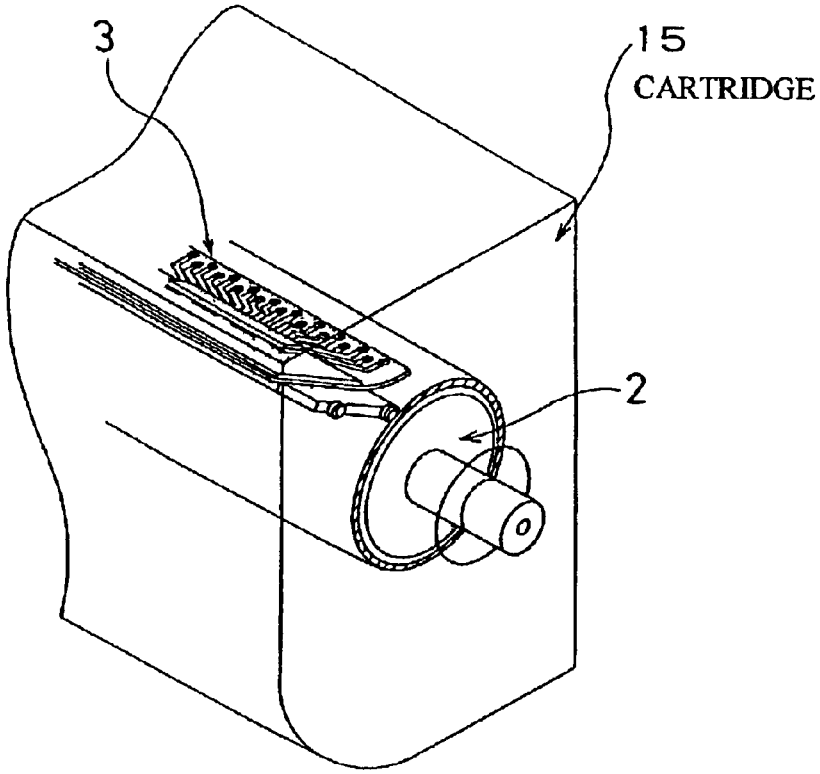
FIG. 10 is a perspective view partially showing a sixth embodiment of the image forming apparatus of the present invention.

FIG. 10 is a perspective view partially showing a sixth embodiment of the image forming apparatus of the present invention.

Though the writing head 3 and the image carrier 2 which are fixed to the common frame 13 are structured as the cartridge 15 in the aforementioned fourth embodiment shown in FIG. 8, a writing head 3 and an image carrier 2 which are fixed to no frame 13 are structured as one cartridge 15 in the image forming apparatus 1 of the sixth embodiment as shown in FIG. 10.

The image forming apparatus 1 of the sixth embodiment has reduced number of parts as compared to the image forming apparatus 1 of the fourth embodiment shown in FIG. 8 because the frame 13 is not used.

The other structure and the other works and effects of the image forming apparatus 1 of the sixth embodiment are the same as those of the aforementioned fourth embodiment shown in FIG. 8.

Figure 11:
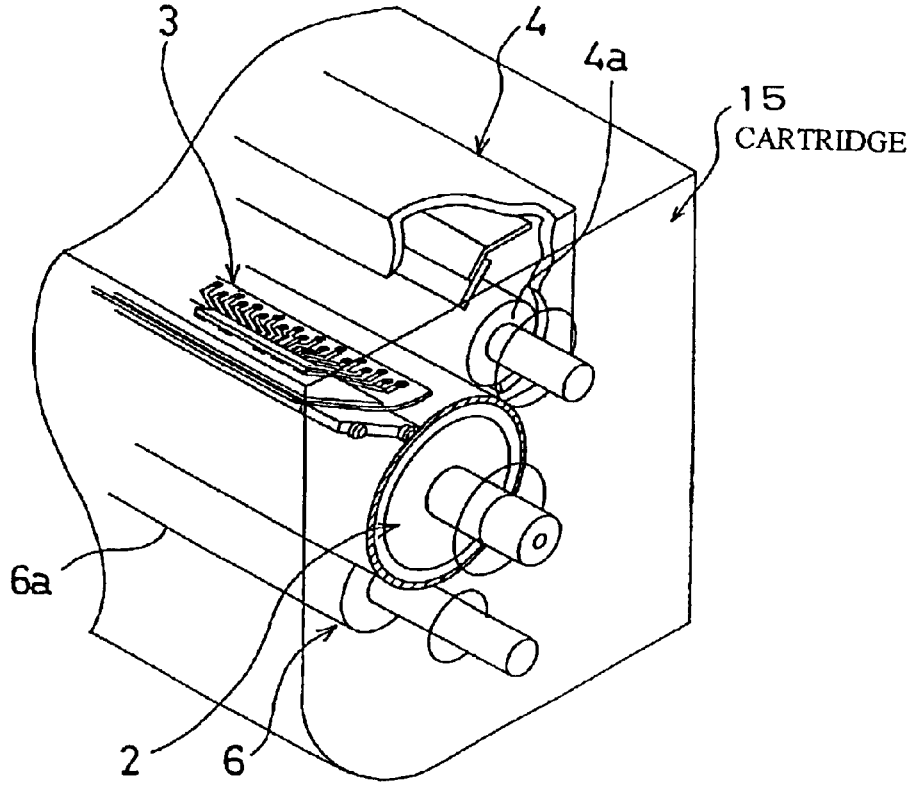
FIG. 11 is a perspective view partially showing a seventh embodiment of the image forming apparatus of the present invention.

FIG. 11 is a perspective view partially showing a seventh embodiment of the image forming apparatus of the present invention.

Though the image carrier 2, the writing head 3, the developing device 4, and the transferring device 6 which are fixed to the common frame 13 are structured as the cartridge 15 in the aforementioned fifth embodiment shown in FIG. 9, an image carrier 2, a writing head 3, a developing device 4, and a transferring device 6 which are fixed to no frame 13 are structured as one cartridge 15 in the image forming apparatus 1 of the seventh embodiment as shown in FIG. 11.

The image forming apparatus 1 of the seventh embodiment has reduced number of parts as compared to the image forming apparatus 1 of the fifth embodiment shown in FIG. 9 because the frame 13 is not used.

The other structure and the other works and effects of the image forming apparatus 1 of the seventh embodiment are the same as those of the aforementioned fifth embodiment shown in FIG. 9.

Though both the developing device 4 and the transferring device 6 are incorporated into the cartridge 15 in the seventh embodiment shown in FIG. 11, at least one of the developing device 4 and the transferring device 6 may be incorporated into the cartridge 15.

Figure 12:
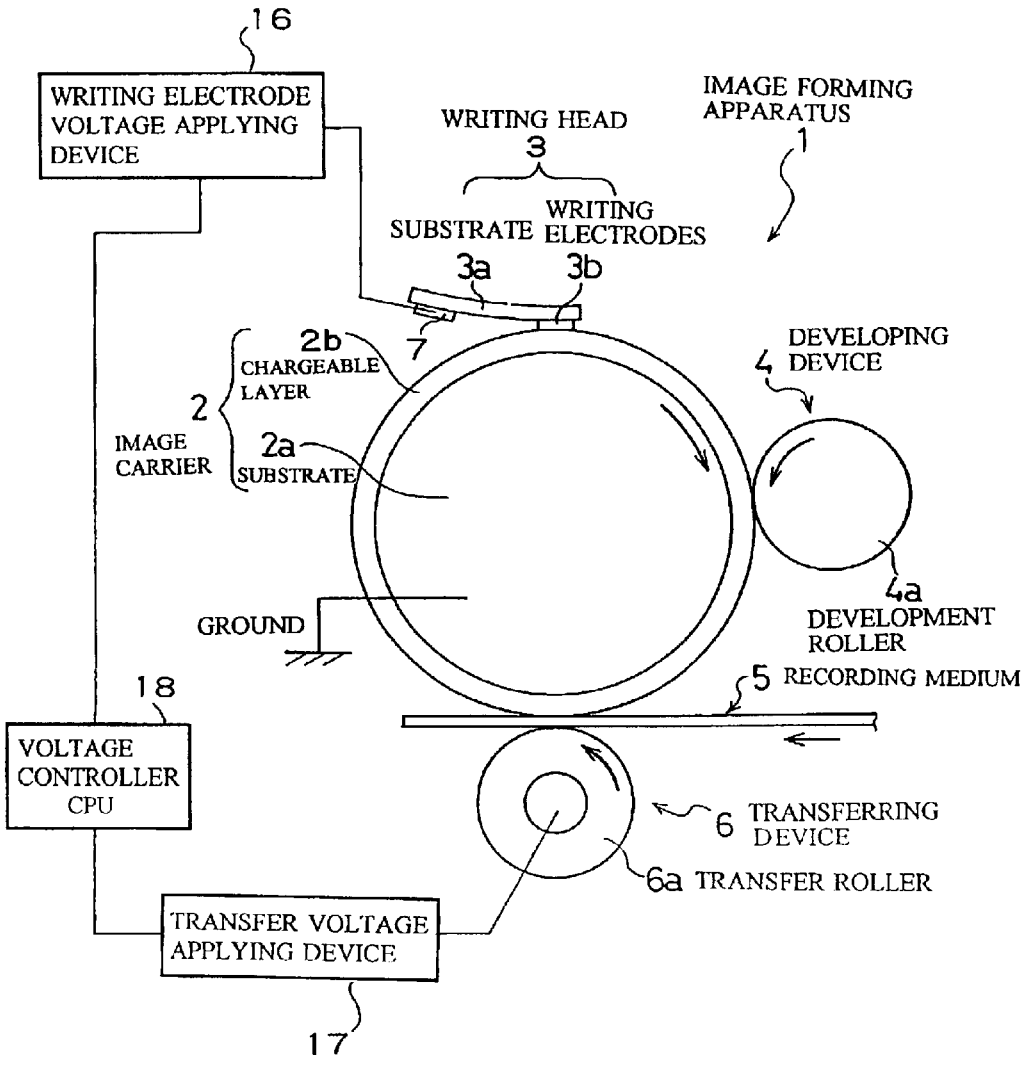
FIG. 12 is an illustration similar to FIG. 1, schematically showing the basic structure of an eighth embodiment of the image forming apparatus according to the present invention.

FIG. 12 is an illustration similar to FIG. 1, schematically showing the basic structure of an eighth embodiment of the image forming apparatus according to the present invention.

As shown in FIG. 12, an image forming apparatus of the eighth embodiment basically comprises the same components of the aforementioned image forming apparatus proposed in the '630 application shown in FIG. 1. In the image forming apparatus of this embodiment, writing voltage is applied to writing electrodes 3*b* from a writing electrode voltage applying device 16 (not shown in FIG. 1) via IC drivers 7 of the writing electrodes 3*b* and transfer voltage is applied to a transfer roller 6*a* from a transfer voltage applying device 17 (not shown in FIG. 1) similar to the image forming apparatus 1 of the '630 application.

The image forming apparatus 1 of the eighth embodiment further comprises a voltage controller (CPU) 18. The voltage controller (CPU) 18 controls the transfer voltage to be applied to the transfer roller 6*a* not to exceed the maximum voltage to be applied to the writing electrodes 3*b* when the transfer roller 6*a* is in contact with the image carrier 2 after a printed paper 5 leaves and before the next paper 5 reaches a portion between the transfer roller 6*a* and the image carrier 2 i.e. no paper exists between the transfer roller 6*a* and the image carrier 2, that is, the voltage controller (CPU) 18 controls the transfer voltage to satisfy the following condition:

the transfer voltage when no paper exists $\leqq$ the maximum applied voltage to the writing electrodes 3*b*.

In the image forming apparatus 1 of the eighth embodiment, the voltage to be applied to the transfer roller 6*a* at the end of transfer and during the initial operation such as the start of the operation of the apparatus is controlled to be lower than the withstand voltage of the IC drivers 7 by the voltage controller (CPU) 18.

The other structure of the image forming apparatus 1 of the eighth embodiment is the same as that of the aforementioned image forming apparatus 1 of the '630 application shown in FIG. 1.

In the image forming apparatus 1 of the eighth embodiment structured as mentioned above, similarly to the aforementioned image forming apparatus 1 of the '630 application shown in FIG. 1, an electrostatic latent image is written on the chargeable layer 2*b* of the image carrier 2 by the writing electrodes 3*b* and is then developed with developer carried by the development roller 4*a* of the developing device 4 to form a developer image, and the developer image is transferred to a paper 5 by the transfer roller 6*a* to which transfer voltage is applied from the transfer voltage applying device 17.

In case of successively printing images on papers 5, the transfer roller 6*a* is in contact with the chargeable layer 2*b* of the image carrier 2 when no paper exists after the printing on a paper 5 is finished and before the next paper 5 reaches the transferring device 6. Since the transfer voltage when no paper exists is set to be equal to or lower than the maximum applied voltage to the writing electrodes 3*b* in the image forming apparatus 1 of the eighth embodiment, reverse charge injection from the transfer roller 6*a* onto the chargeable layer 2*b* of the image carrier 2 never occurs even though the transfer voltage is continuously applied to the transfer roller 6*a*. Even when the writing is conducted by the writing electrodes 3*b* in this state, the current flowing to the writing electrodes never exceed the withstand voltage of the high-voltage IC drivers 7 connected to the writing electrodes 3*b*.

Therefore, in the image forming apparatus 1 of the eighth embodiment, the reverse charge injection never occurs at the transfer portion and the current exceeding the withstand voltage of the IC drivers 7 never flows to the writing electrodes 3*b*, thereby preventing the writing head 3 from being broken, prevents the production of ghost image, and further inhibits voltage drop due to discharge between the image carrier 2 and the writing electrodes 3*b* during the process of writing a latent image so as to prevent the electrostatic latent image from being in disorder.

Even when the transfer voltage is increased for conducting the transfer in the environment of low-temperature and low-humidity (LL), the IC drivers 7 of the writing electrodes 3*b* can be prevented from being broken.

Since the reverse charge injection never occurs at the transfer portion, an electric potential difference exceeding the discharge starting voltage does not exist when the writing electrodes 3*b* and the image carrier 2 are in contact with each other. Production of vibration of the writing electrodes 3*b* can be therefore prevented in spite of the frequency of ON/OFF signals applied to the writing electrodes 3*b*. Accordingly, the contact between the writing electrodes 3*b* and the image carrier 2 can be stabilized, thereby obtaining excellent reproducibility of latent images.

The other works and effects of the image forming apparatus 1 of the eighth embodiment are the same as those of the image forming apparatus 1 of the '630 application shown in FIG. 1.

Figure 13:
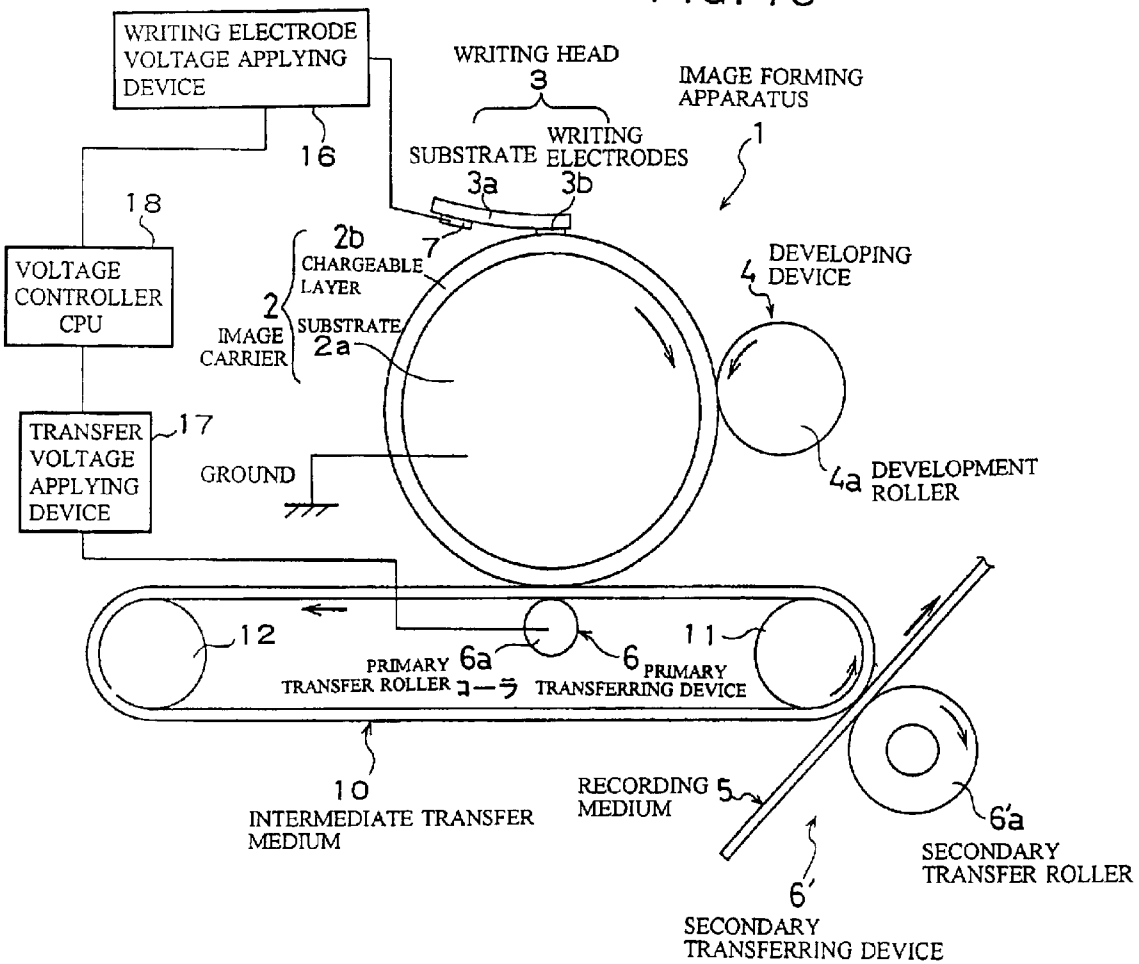
FIG. 13 is an illustration similar to FIG. 12, schematically showing the basic structure of a ninth embodiment of the image forming apparatus according to the present invention.

FIG. 13 is an illustration similar to FIG. 12, schematically showing the basic structure of a ninth embodiment of the image forming apparatus according to the present invention.

Though the aforementioned eighth embodiment shown in FIG. 12 is an embodiment in which the present invention is applied to an image forming apparatus 1 not conducting the intermediate transfer, an image forming apparatus 1 of the ninth embodiment shown in FIG. 13 is of a type that primarily transfers a developer image on the image carrier 2 onto an intermediate transfer medium 10 in an endless belt shape being in contact with the image carrier 2 by a primary transferring device 6 and secondarily transfers the developer image on the intermediate transfer medium 10 onto a paper 5 by a secondary transfer roller 6'*a* of a secondary transferring device 6' as known in the prior art.

The primary transferring device 6 comprises a primary transfer roller 6*a* for pressing the intermediate transfer medium 10 against the image carrier 2. The primary transfer voltage from the transfer voltage applying device 17 is applied to the intermediate transfer medium 10 via the primary transfer roller 6*a*. On the other hand, the secondary transfer voltage from the secondary transfer voltage applying device (not shown) is applied to the secondary transfer roller 6'*a*.

The intermediate transfer medium 10 in an endless belt shape is wound onto and tightly held by a driving roller 11 and a driven roller 12 and is driven to circulate by the driving roller 11 which is driven by a motor (not shown).

A voltage controller (CPU) 18 of the ninth embodiment controls the transfer voltage at a non-image area of the intermediate transfer medium 10 not to exceed the maximum voltage to be applied to the writing electrodes 3*b*, that is, the voltage controller (CPU) 18 controls the transfer voltage to satisfy the following condition:

the transfer voltage at the non-image area ≦ the maximum applied voltage to the writing electrodes 3*b*.

Also in the image forming apparatus 1 of the ninth embodiment, the voltage to be applied to the transfer roller 6*a* at the end of transfer and during the initial operation such as the start of the operation of the apparatus is controlled to be lower than the withstand voltage of the IC drivers 7 by the voltage controller (CPU) 18.

The other structure of the image forming apparatus 1 of the ninth embodiment is the same as that of the image forming apparatus 1 of the eighth embodiment shown in FIG. 12.

In the image forming apparatus 1 of the ninth embodiment structured as mentioned above, after the chargeable layer 2*b* of the image carrier 2 is made into the uniformly charged state, voltage is applied to the writing electrodes 3*b* from the writing voltage applying device 16 so that an electrostatic latent image is written on the chargeable layer 2*b* of the image carrier 2 mainly via the contact-charge transfer between image carrier 2 and the writing electrodes 3*b* of the writing head 3 which are in plane contact with each other, similarly to any of the aforementioned image forming apparatuses. The electrostatic latent image on the chargeable layer 2*b* of the image carrier 2 is then developed with developer carried by the development roller 4*a* of the developing device 4 to form a developer image, and the developer image is transferred to the intermediate transfer medium 10 to which primary transfer voltage is applied from the transfer voltage applying device 17 via the primary transfer roller 6*a* in the primary transferring device 6.

Even when the non-image area of the intermediate transfer medium 10 is in contact with the chargeable layer 2*b* of the image carrier 2, reverse charge injection from the intermediate transfer medium 10 onto the chargeable layer 2*b* of the image carrier 2 never occurs at the aforementioned transfer portion because the transfer voltage at the non-image area is set to be equal to or lower than the maximum applied voltage to the writing electrodes 3*b* in the image forming apparatus 1 of the ninth embodiment. Even when the writing is conducted by the writing electrodes 3*b* in this state, the current flowing to the writing electrodes never exceed the withstand voltage of the high-voltage IC drivers 7 connected to the writing electrodes 3*b*.

The other works and effects of the image forming apparatus 1 of the ninth embodiment are the same as those of the image forming apparatus 1 of the eighth embodiment shown in FIG. 12.

Figure 14:
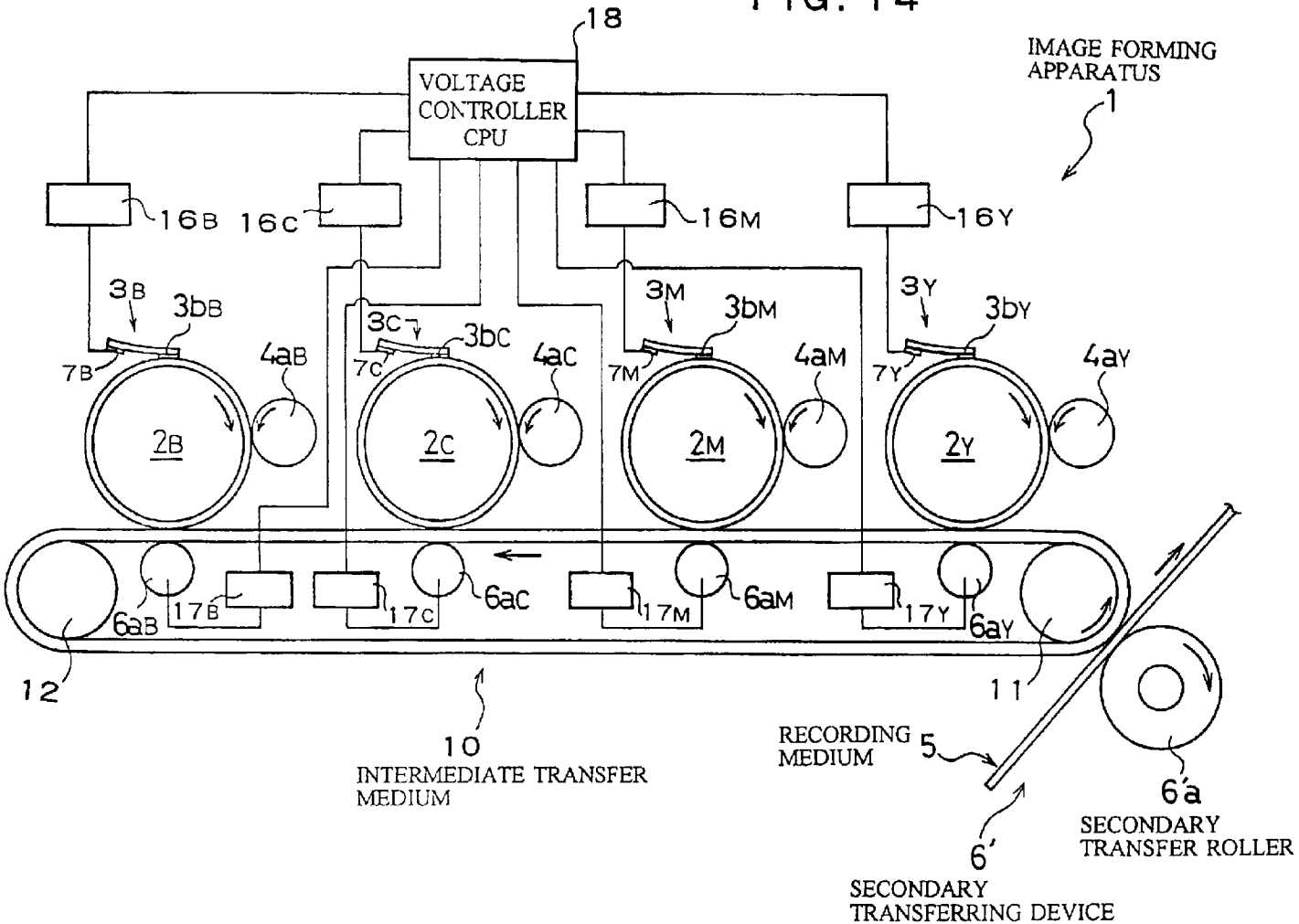
FIG. 14 is an illustration schematically showing a full-color image forming apparatus structured by combining four image forming apparatuses, except intermediate transfer media and secondary transferring devices, of the ninth embodiment shown in FIG. 13 which are each provided for each color, i.e. yellow, magenta, cyan, black.

FIG. 14 is an illustration schematically showing a full-color image forming apparatus structured by combining four image forming apparatuses, except intermediate transfer media and secondary transferring devices, of the ninth embodiment shown in FIG. 13 which are each provided for each color, i.e. yellow, magenta, cyan, black.

As shown in FIG. 14, the full-color image forming apparatus 1 of this embodiment comprises image carriers $\mathbf{2}_Y$, $\mathbf{2}_M$, $\mathbf{2}_C$, $\mathbf{3}_B$, writing heads $\mathbf{3}_Y$, $\mathbf{3}_M$, $\mathbf{3}_C$, $\mathbf{3}_B$ provided with writing electrodes $\mathbf{3}b_Y$, $\mathbf{3}b_M$, $\mathbf{3}b_C$, $\mathbf{3}b_B$, development rollers $\mathbf{4}a_Y$, $\mathbf{4}a_M$, $\mathbf{4}a_C$, $\mathbf{4}a_B$, which are provided for four colors of yellow Y, magenta M, cyan C, and black B, respectively. The full-color image forming apparatus 1 of this embodiment further comprises an intermediate transfer medium 10 in an endless belt shape which is common to the four colors and primary transfer rollers $\mathbf{6}a_Y$, $\mathbf{6}a_M$, $\mathbf{6}a_C$, and $\mathbf{6}a_B$ which are provided for the four colors, respectively, for bringing the intermediate transfer medium 10 in contact with the image carriers $\mathbf{2}_Y$, $\mathbf{2}_M$, $\mathbf{2}_C$, and $\mathbf{3}_B$, respectively.

The full-color image forming apparatus 1 of this embodiment further comprises writing electrode voltage applying devices $\mathbf{16}_Y$, $\mathbf{16}_M$, $\mathbf{16}_C$, $\mathbf{16}_B$ for individually applying writing electrode voltages to the writing electrodes $\mathbf{3}b_Y$, $\mathbf{3}b_M$, $\mathbf{3}b_C$, $\mathbf{3}b_B$ of the writing heads $\mathbf{3}_Y$, $\mathbf{3}_M$, $\mathbf{3}_C$, $\mathbf{3}_B$ for the respective colors via IC drivers $\mathbf{7}_Y$, $\mathbf{7}_M$, $\mathbf{7}_C$, $\mathbf{7}_B$ for the respective colors and still comprises transfer voltage applying devices $\mathbf{17}_Y$, $\mathbf{17}_M$, $\mathbf{17}_C$, $\mathbf{17}_B$ for the respective colors for individually applying transfer voltages to the intermediate transfer medium 10 via the primary transfer rollers $\mathbf{6}a_Y$, $\mathbf{6}a_M$, $\mathbf{6}a_C$, $\mathbf{6}a_B$ for the respective colors. The writing electrode voltage applying devices $\mathbf{16}_Y$, $\mathbf{16}_M$, $\mathbf{16}_C$, $\mathbf{16}_B$ and the transfer voltage applying devices $\mathbf{17}_Y$, $\mathbf{17}_M$, $\mathbf{17}_C$, $\mathbf{17}_B$ are connected to the common voltage controller (CPU) 18 so that the writing electrode voltage applying devices $\mathbf{16}_Y$, $\mathbf{16}_M$, $\mathbf{16}_C$, $\mathbf{16}_B$ and the transfer voltage applying devices $\mathbf{17}_Y$, $\mathbf{17}_M$, $\mathbf{17}_C$, $\mathbf{17}_B$ are controlled by the voltage controller (CPU) 18 whereby the respective applying voltage is independently controlled.

The full-color image forming apparatus 1 further comprises a secondary transfer device 6' for transferring a developer image, which was primarily transferred on the intermediate transfer medium 10, onto a paper (recording medium) 5.

The respective combinations of the image carriers $\mathbf{2}_Y$, $\mathbf{2}_M$, $\mathbf{2}_C$, $\mathbf{3}_B$, the writing heads $\mathbf{3}_Y$, $\mathbf{3}_M$, $\mathbf{3}_C$, $\mathbf{3}_B$, and the development rollers $\mathbf{4}a_Y$, $\mathbf{4}a_M$, $\mathbf{4}a_C$, $\mathbf{4}a_B$ are arranged in tandem in this order from the upstream in the rotational direction of the intermediate transfer medium 10 (the counterclockwise direction in FIG. 14). It should be understood that the combinations for the respective colors may be arranged in any order.

The intermediate transfer medium 10 in an endless belt shape is wound onto and tightly held by a driving roller 11 and a driven roller 12 and is driven to circulate by the driving roller 11 driven by a motor (not shown). By passing a paper (recording medium) 5 between the intermediate transfer medium 10 and the secondary transfer roller 6'*a* at the driving roller 11 with some pressure, the secondary transfer onto the paper (recording medium) 5 is carried out.

The full-color image forming apparatus 1 is provided with a secondary transfer voltage applying device for applying secondary transfer voltage to the secondary transfer roller 6'*a*, similarly to the image forming apparatus of the ninth embodiment shown in FIG. 13, but not illustrated in FIG. 14.

In the full-color image forming apparatus of this embodiment, the voltage controller (CPU) 18 controls the intermediate transfer voltage not to exceed the lowest one among the maximum voltages to be applied to the writing electrodes $\mathbf{3}b_Y$, $\mathbf{3}b_M$, $\mathbf{3}b_C$, $\mathbf{3}b_B$ for the respective colors, that is, the voltage controller (CPU) 18 controls the intermediate transfer voltage to satisfy the following condition:

the intermediate transfer voltage at the non-image area ≦ the lowest one among the maximum applied voltages to the writing electrodes $\mathbf{3}b_Y$, $\mathbf{3}b_M$, $\mathbf{3}b_C$, $\mathbf{3}b_B$.

The other structure of the full-color image forming apparatus 1 is the same as that of the image forming apparatus 1 of the ninth embodiment shown in FIG. 13.

In the full-color image forming apparatus 1 of this embodiment structured as mentioned above, an electrostatic latent image for yellow Y is written on the chargeable layer $2b_Y$ of the image carrier $2_Y$ for yellow Y by the writing electrodes $3b_Y$ for yellow Y. The electrostatic latent image for yellow Y is then developed by the development roller $4a_Y$ for yellow Y to form a developer image for yellow Y on the chargeable layer $2b_Y$ of the image carrier $2_Y$. The developer image for yellow Y is primarily transferred to the intermediate transfer medium 10.

Then, an electrostatic latent image for magenta M is written on the chargeable layer $2b_M$ of the image carrier $2_M$ for magenta M by the writing electrodes $3b_M$ for magenta M. The electrostatic latent image for magenta M is then developed by the development roller $4a_M$ for magenta M to form a developer image for magenta M on the chargeable layer $2b_M$ of the image carrier $2_M$. The developer image for magenta M is primarily transferred and superposed onto the developer image for yellow Y on the intermediate transfer medium 10.

Subsequently, an electrostatic latent image for cyan C is written on the chargeable layer $2b_C$ of the image carrier $2_C$ for cyan C by the writing electrodes $3b_C$ for cyan C. The electrostatic latent image for cyan C is then developed by the development roller $4a_C$ for cyan C to form a developer image for cyan C on the chargeable layer $2b_C$ of the image carrier $2_C$. The developer image for cyan C is primarily transferred and superposed onto the developer images for yellow Y and for magenta M on the intermediate transfer medium 10.

Further, an electrostatic latent image for black B is written on the chargeable layer $2b_B$ of the image carrier $3_B$ for black B by the writing electrodes $3b_B$ for black B. The electrostatic latent image for black B is then developed by the development roller $4a_B$ for black B to form a developer image for black B on the chargeable layer $2b_B$ of the image carrier $3_B$. The developer image for black B is primarily transferred and superposed onto the developer images for yellow Y, for magenta M, and for cyan C on the intermediate transfer medium 10, thereby forming a full-color developer image on the intermediate transfer medium 10. The full-color developer image on the intermediate transfer medium 10 is secondarily transferred to a paper (recording medium) 5 by the secondary transfer roller 6'*a*.

Even when the non-image area of the intermediate transfer medium 10 is in contact with any of the chargeable layers $2b_Y$, $2b_M$, $2b_C$, $2b_B$, of the image carriers $2_Y$, $2_M$, $2_C$, $3_B$, reverse charge injection from the intermediate transfer medium 10 onto the chargeable layers $2b_Y$, $2b_M$, $2b_C$, $2b_B$, of the image carriers $2_Y$, $2_M$, $2_C$, $3_B$ never occurs at the aforementioned transfer portion because the transfer voltage at the non-image area of the intermediate transfer medium 10 is set to be equal to or lower than the lowest one among the maximum applied voltages to the writing electrodes $3b_Y$, $3b_M$, $3b_C$, $3b_B$. Even when the writing is conducted by the writing electrodes $3b_Y$, $3b_M$, $3b_C$, $3b_B$ in this state, the current flowing to the writing electrodes $3b_Y$, $3b_M$, $3b_C$, $3b_B$ never exceeds the withstand voltage of the high-voltage IC drivers $7_Y$, $7_M$, $7_C$, $7_B$ connected to the writing electrodes $3b_Y$, $3b_M$, $3b_C$, $3b_B$, respectively.

The other works and effects of the full-color image forming apparatus 1 of this embodiment are the same as those of the aforementioned ninth embodiment shown in FIG. 13.

Figure 15A:
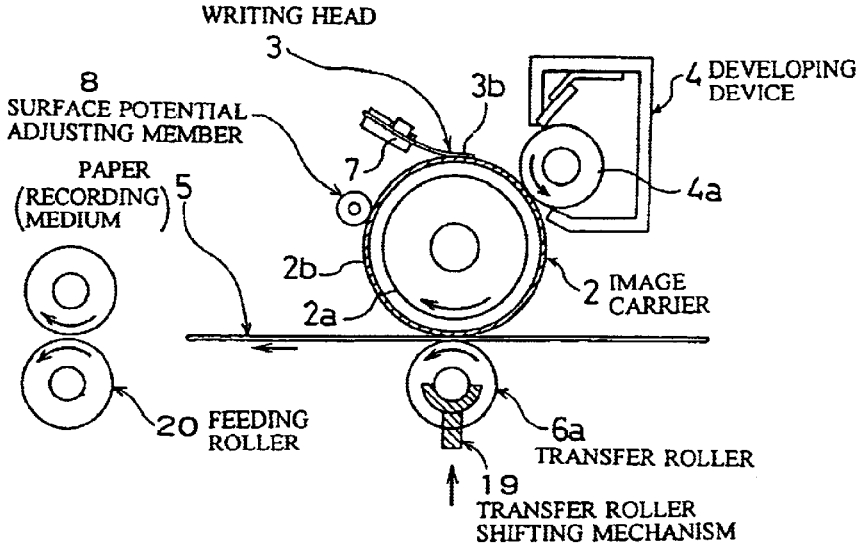
FIGS. 15(*a*) and 15(*b*) schematically show the basic structure of a tenth embodiment of the image forming apparatus according to the present invention, wherein FIG. 15(*a*) is an illustration similar to FIG. 1, showing the state where the image forming apparatus of the tenth embodiment conducts the transferring operation and FIG. 15(*b*) is an illustration similar to FIG. 1, showing the state where the image forming apparatus of the tenth embodiment does not conduct the transferring operation.
Figure 15B:
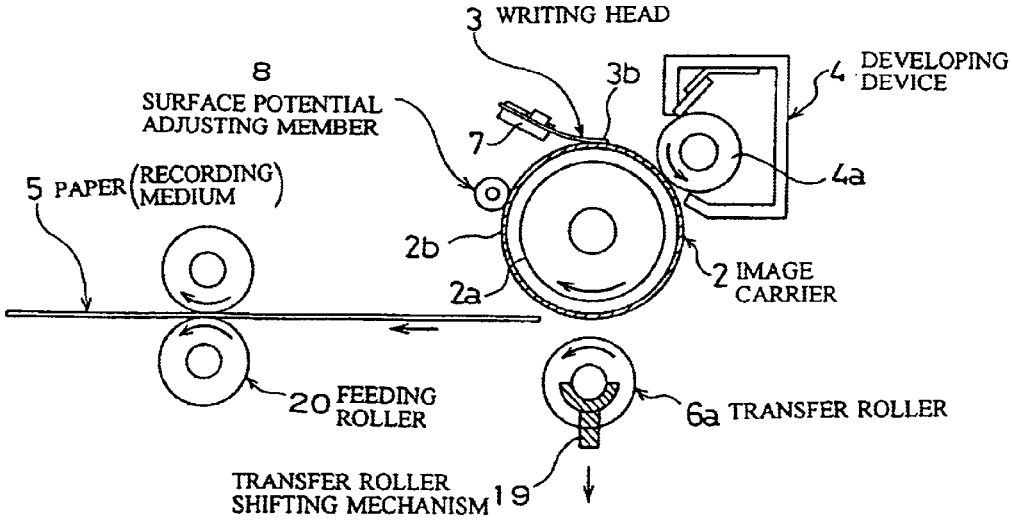

FIGS. 15(*a*) and 15(*b*) schematically show a tenth embodiment of the image forming apparatus according to the present invention, wherein FIG. 15(*a*) is an illustration similar to FIG. 1, showing the state where the image forming apparatus of the tenth embodiment conducts the transferring operation and FIG. 15(*b*) is an illustration similar to FIG. 1, showing the state where the image forming apparatus of the tenth embodiment does not conduct the transferring operation.

The image forming apparatus 1 of the tenth embodiment also basically comprises the same components of the image forming apparatus of the '630 application shown in FIG. 1. As shown in FIGS. 15(*a*) and 15(*b*), the image forming apparatus 1 of the tenth embodiment further comprises a transfer roller shifting mechanism (corresponding to the transfer member shifting mechanism of the present invention) 19 for moving a transfer roller 6*a* of a transferring device 6 closer to or apart from an image carrier 2. The operation of the transfer roller shifting mechanism 19 is controlled by an electric controller (not shown) of the image forming apparatus 1 such a manner as to bias the transfer roller 6*a* against the chargeable layer 2*b* to bring a paper (recording medium) 5 into contact with the chargeable layer 2*b* when the operation of transferring a developer image on the image carrier 2 to the paper 5 is conducted and to separate the transfer roller 6*a* from the chargeable layer 2*b* when the operation of transferring a developer image on the image carrier 2 to the paper 5 is not conducted.

Therefore, when the transferring operation is conducted as shown in FIG. 15(*a*), the transfer roller 6*a* presses the paper 5 against the chargeable layer 2*b* of the image carrier 2 so as to transfer a developer image on the image carrier 2 to the paper 5 by applied transfer voltage. On the other hand, when the paper 5 is passing through a space between the image carrier 2 and the transfer roller 6*a* and the transferring operation is thus not conducted as shown in FIG. 15(*b*), the transfer roller 6*a* is spaced apart from the chargeable layer 2*b* of the image carrier 2.

In the image forming apparatus 1 of the tenth embodiment, similarly to the aforementioned first embodiment shown in FIG. 3(*a*), a surface potential adjusting member 8 is positioned downstream of the contact portion of the chargeable layer 2*b* with the transfer roller 6*a* and between the contact portion of the chargeable layer 2*b* with the writing head 3 in the rotational direction of the image carrier 2 and the contact portion of the chargeable layer 2*b* with the transfer roller 6*a*. The surface potential adjusting member 8 is arranged to be in contact with the chargeable layer 2*b* of the image carrier 2. The surface potential adjusting member 8 is set to rotate to have a predetermined peripheral surface speed ratio relative to the image carrier 2.

A surface potential adjusting bias voltage composed of an alternating current (AC) voltage superimposed on a direct current (DC) voltage is applied to the surface potential adjusting member 8, whereby the surface potential adjusting member 8 adjusts the voltage at a portion of the chargeable layer 2*b* of the image carrier 2 where the writing electrodes 3*b* are in contact with. It should be noted that the surface potential adjusting bias voltage may be composed of only a DC voltage. The DC voltage of the surface potential adjusting bias voltage is set to a predetermined voltage including 0 (zero) V. The value of the DC voltage is preferably set to be the same as the value of the latent image forming bias voltage applied to the image carrier 2. In the illustrated embodiment, the image carrier 2 is grounded so that a DC voltage of 0 (zero) V is applied to the image carrier 2.

The other structure of the image forming apparatus of the tenth embodiment is the same as that of the aforementioned image forming apparatus of the '630 application shown in FIG. 1.

In the image forming apparatus 1 of the tenth embodiment structured as mentioned above, an electrostatic latent image is written onto the chargeable layer 2*b* of the image carrier 2 by the writing electrodes 3*b* and the electrostatic latent image on the chargeable layer 2*b* is then developed with developer carried by the development roller 4*a* of the developing device 4 to form a developer image. The developer image is transferred to a paper 5 by the transfer roller 6*a* to which transfer voltage is applied. The paper 5 with the developer image thereon is carried by a feeding roller 20 to a fixing device (not shown) where the developer image on the paper 5 is fixed.

During the developer image on the image carrier 2 is transferred to the paper 5, the transfer roller shifting mechanism 19 biases the transfer roller 6*a* against the chargeable layer 2*b* of the image carrier 2 so that the transfer roller 6*a* brings the paper 5 into contact with the chargeable layer 2*b*. In this state, the transfer voltage is applied to the transfer roller 6*a* whereby the developer image on the image carrier 2 is transferred to the paper 5.

When the operation of transferring the developer image on the image carrier 2 to a paper 5 is not conducted because no paper 5 exists between the image carrier 2 and the transfer roller 6, for example, before the start of the transferring operation, after the finish of the transferring operation, or at an interval between a printed paper 5 and the next paper in case of successively printing images on a predetermined number of papers 5, the transfer roller 6*a* is spaced apart from the chargeable layer 2*b* of the image carrier 2 by the transfer roller shifting mechanism 19. Therefore, the reverse charge injection from the transfer roller 6*a* onto the chargeable layer 2*b* of the image carrier 2 never occurs when the transferring operation is not conducted and the current exceeding the withstand voltage of the IC drivers 7 never flows to the writing electrodes 3*b*.

Therefore, this prevents the writing head 3 (specially, the IC drivers 7) from being broken and prevents the production of ghost image. This further inhibits voltage drop due to discharge between the image carrier 2 and the writing electrodes 3*b* during the process of writing a latent image, thereby preventing the electrostatic latent image from being in disorder.

Even when the transfer voltage is increased for conducting the transfer in the environment of low-temperature and low-humidity (LL), the IC drivers 7 of the writing electrodes 3*b* can be prevented from being broken and the IC drivers 7 can be protected.

Since the occurrence of reverse charge injection at the transfer portion is prevented, an electric potential difference exceeding the discharge starting voltage does not exist when the writing electrodes 3*b* and the image carrier 2 are in contact with each other. Therefore, production of vibration to the writing electrodes 3*b* due to static electricity can be prevented in spite of the frequency of ON/OFF signals applied to the writing electrodes 3*b*. Accordingly, the contact between the writing electrodes 3*b* and the image carrier 2 can be stabilized, thereby obtaining excellent reproducibility of latent images.

The voltage of the chargeable layer 2*b* at the portion of the chargeable layer 2*b* being in contact with the writing electrodes 3*b* are controlled by the surface potential adjusting member 8 disposed to be in contact with the chargeable layer 2*b* of the image carrier 2 between the writing electrodes 3*b* and the transfer roller 6*a*. By the surface potential adjusting member 8, the potential of the chargeable layer 2*b* at the portion of the chargeable layer 2*b* being in contact with the writing electrodes 3*b* is controlled not to exceed the withstand voltage of the IC drivers 7 of the writing electrodes 3*b*.

Therefore, the writing electrodes 3*b* and the IC drivers 7 of the writing head 3 can be securely prevented from being broken, the production of ghost image can be reliably prevented, and voltage drop due to discharge between the image carrier 2 and the writing electrodes 3*b* can be inhibited during the process of writing a latent image, thereby further reliably preventing the electrostatic latent image from being in disorder.

The surface potential adjusting member 8 has a predetermined peripheral surface speed ratio relative to the image carrier 2, thus improving the potential adjustment of the chargeable layer 2*b*. In addition, the surface potential adjusting member 8 is composed of a rotatable conductive roller such as a conductive fur brush, a conductive rubber roller, or a conductive magnetic brush so as to increase the situation where the conductive roller is in contact with the image carrier 2, thereby further improving the potential adjustment of the chargeable layer 2*b*. By designing the conductive roller to be in elastically contact with the image carrier 2, the contact ability is improved, further improving the potential adjustment of the chargeable layer 2*b*.

The surface potential adjusting bias voltage to be applied to the surface potential adjusting member 8 is set to a voltage composed of an AC voltage having a suitable frequency superimposed on a direct current set as a reference voltage (e.g. ground reference voltage) to be applied to the image carrier 2, thereby efficiently collecting negatively charged residual developer remaining on the image carrier 2 after transfer and securely adjusting the surface potential of the chargeable layer 2*b* of the image carrier 2 to the reference bias voltage (e.g. the ground reference voltage).

The other works and effects of the image forming apparatus 1 of the tenth embodiment are the same as those of the image forming apparatus 1 of the '630 application shown in FIG. 1.

Figure 16:
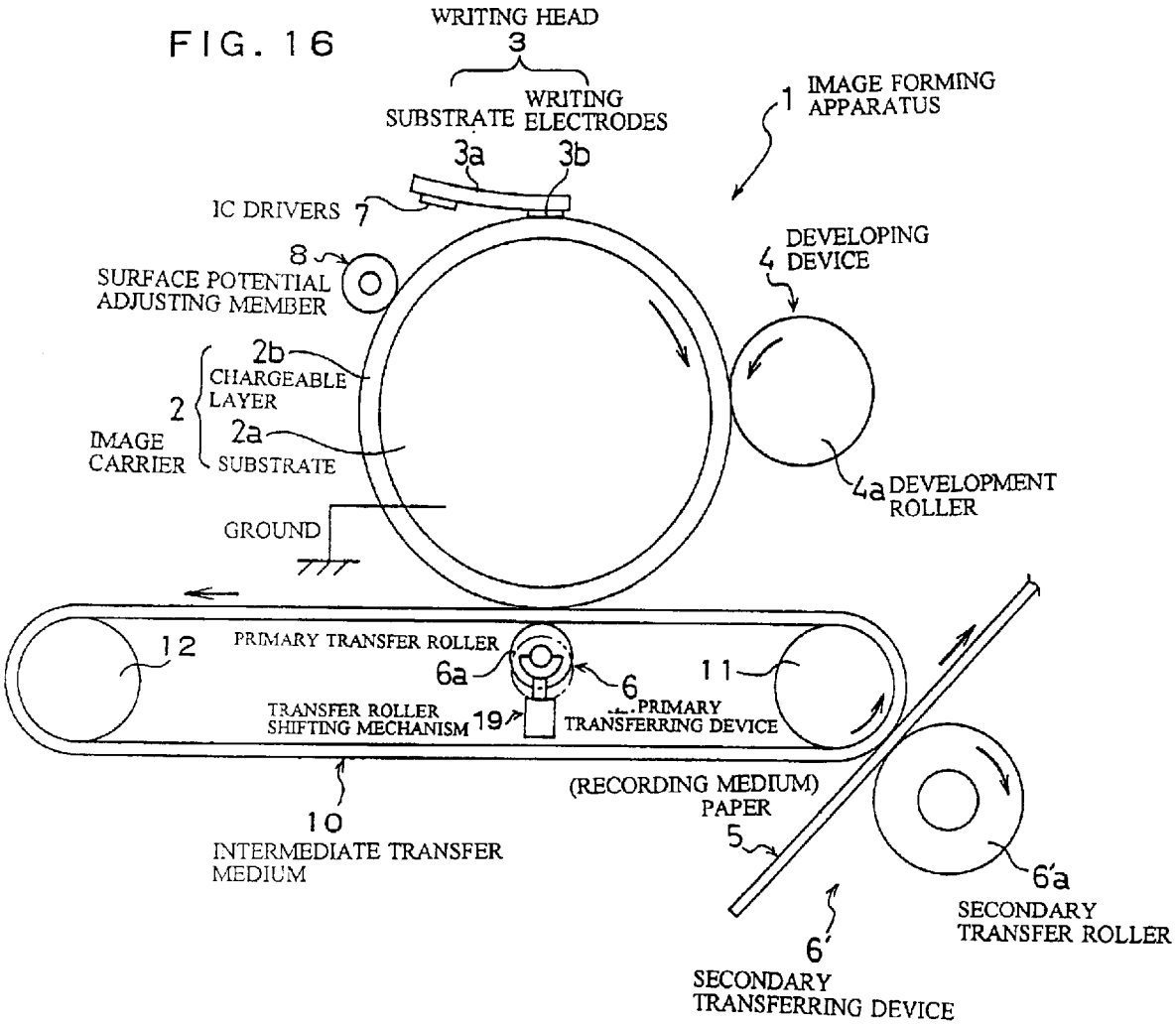
FIG. 16 is an illustration similar to FIG. 15, schematically showing the basic structure of a eleventh embodiment of the image forming apparatus according to the present invention.

FIG. 16 is an illustration similar to FIG. 15, schematically showing the basic structure of an eleventh embodiment of the image forming apparatus according to the present invention.

Though the aforementioned tenth embodiment shown in FIGS. 15(*a*), 15(*b*) is an embodiment in which the present invention is applied to an image forming apparatus 1 not conducting the intermediate transfer, an image forming apparatus 1 of the eleventh embodiment shown in FIG. 16 is of a type that primarily transfers a developer image on the image carrier 2 onto an intermediate transfer medium 10 in an endless belt shape being in contact with the image carrier 2 by a primary transferring device 6 and secondarily transfers the developer image on the intermediate transfer medium 10 onto a paper (recording medium) 5 by a secondary transfer roller 6'*a* of a secondary transferring device 6' as known in the prior art.

The primary transferring device 6 comprises a primary transfer roller 6*a* which is connected to a transfer roller shifting mechanism 19 as stated above so that the primary transfer roller 6*a* is biased by the transfer roller shifting mechanism 19 so as to press the intermediate transfer medium 10 against the image carrier 2 and thus bring the intermediate transfer medium 10 into contact with the chargeable layer 2*b* of the image carrier 2 as shown by a solid line in FIG. 16. In this state, the primary transfer voltage is applied to the primary transfer roller 6*a* whereby the developer image on the image carrier 2 is primarily transferred to the intermediate transfer medium 10. When the primary transfer operation is not conducted, the primary transfer roller 6*a* is spaced apart from the intermediate transfer medium 10 by the transfer roller shifting mechanism 19 as shown by a two-dot chain line in FIG. 16. On the other hand, the secondary transfer voltage is applied to the secondary transfer roller 6'*a* of the secondary transfer device 6'.

The intermediate transfer medium 10 in an endless belt shape is wound onto and tightly held by a driving roller 11 and a driven roller 12 and is driven to circulate by the driving roller 11 which is driven by a motor (not shown).

The other structure of the image forming apparatus 1 of the eleventh embodiment is the same as that of the image forming apparatus 1 of the tenth embodiment shown in FIGS. 15(*a*), 15(*b*).

In the image forming apparatus 1 of the eleventh embodiment structured as mentioned above, an electrostatic latent image is written on the chargeable layer 2*b* of the image carrier 2 by the writing electrodes 3*b*, similarly to any of the aforementioned embodiments. The electrostatic latent image on the chargeable layer 2*b* of the image carrier 2 is then developed with developer carried by the development roller 4*a* of the developing device 4 to form a developer image, and the developer image is transferred to the intermediate transfer medium 10 by the primary transfer roller 6*a* to which the primary transfer voltage is applied in the primary transferring device 6. Further, the developer image primary transferred on the intermediate transfer medium 10 is secondarily transferred onto a paper 5 by the secondary transfer roller 6'*a* in the secondary transferring device 6'.

When the primary transfer is not conducted, for example, the non-image area of the intermediate transfer medium 10 comes in contact with the chargeable layer 2*b* of the image carrier 2, the primary transfer roller 6*a* is spaced apart from the intermediate transfer medium 10 so that the reverse charge injection from the intermediate transfer medium 10 to the chargeable layer 2*b* never occurs.

The other works and effects of the image forming apparatus 1 of the eleventh embodiment are the same as those of the image forming apparatus 1 of the image forming apparatus 1 of the tenth embodiment shown in FIG. 15.

Figure 17:
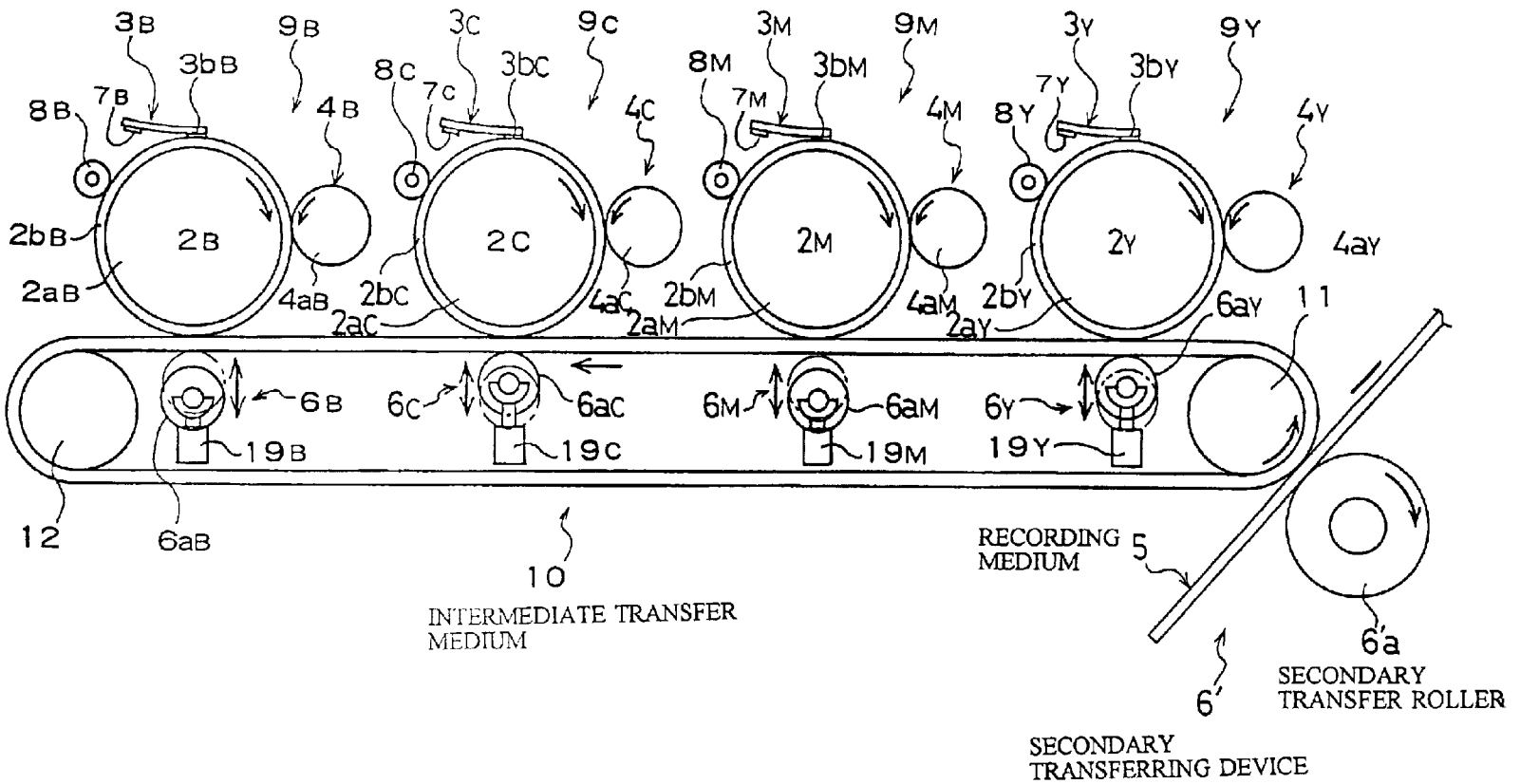
FIG. 17 is an illustration schematically showing a full-color image forming apparatus made up of a combination of plural image forming apparatuses shown in FIG. 16 of the eleventh embodiment according to the present invention.

FIG. 17 is an illustration schematically showing a full-color image forming apparatus made by combining plural image forming apparatuses, except intermediate transfer media and secondary transferring devices, of the eleventh embodiment shown in FIG. 16 which are each provided for each color, i.e. yellow, magenta, cyan, black.

Among the components of the image forming apparatus 1 of the eleventh embodiment shown in FIG. 16, the writing head 3, the developing device 4, the image carrier 2, and the surface potential adjusting member 8 make up an image carrier unit 9 in the full-color image forming apparatus 1 of this embodiment as shown in FIG. 17. The image forming apparatus 1 comprises four image carrier units 9, four primary transferring devices 6 each having a primary transfer roller 6*a*, and four transfer roller shifting mechanisms 19 which are provided for four colors of yellow Y, magenta M, cyan C, and black B, respectively. That is, the full-color image forming apparatus 1 comprises image carrier units $\mathbf{9}_Y$, $\mathbf{9}_M$, $\mathbf{9}_C$, $\mathbf{9}_B$, primary transferring devices $\mathbf{6}_Y$, $\mathbf{6}_M$, $\mathbf{6}_C$, $\mathbf{6}_B$ having primary transfer rollers $\mathbf{6}a_Y$, $\mathbf{6}a_M$, $\mathbf{6}a_C$, $\mathbf{6}a_B$, and the transfer roller shifting mechanisms $\mathbf{19}_Y$, $\mathbf{19}_M$, $\mathbf{19}_C$, $\mathbf{19}_B$.

Each image carrier unit $\mathbf{9}_Y$, $\mathbf{9}_M$, $\mathbf{9}_C$, $\mathbf{9}_B$ comprises an image carrier $\mathbf{2}_Y$, $\mathbf{2}_M$, $\mathbf{2}_C$, $\mathbf{2}_B$ having a substrate $\mathbf{2}a_Y$, $\mathbf{2}a_M$, $\mathbf{2}a_C$, $\mathbf{2}a_B$ and a chargeable layer $\mathbf{2}b_Y$, $\mathbf{2}b_M$, $\mathbf{2}b_C$, $\mathbf{2}b_B$, a writing head $\mathbf{3}_Y$, $\mathbf{3}_M$, $\mathbf{3}_C$, $\mathbf{3}_B$ provided with writing electrodes $\mathbf{3}b_Y$, $\mathbf{3}b_M$, $\mathbf{3}b_C$, $\mathbf{3}b_B$, a development roller $\mathbf{4}a_Y$, $\mathbf{4}a_{M,\ 4}a_C$, $\mathbf{4}a_B$, and a surface potential adjusting member $\mathbf{8}_Y$, $\mathbf{8}_M$, $\mathbf{8}_C$, $\mathbf{8}_B$ for the corresponding color, i.e. yellow Y, magenta M, cyan C, or black B.

The full-color image forming apparatus 1 of this embodiment further comprises an intermediate transfer medium 10 and a secondary transferring device 6' which are common to the four colors. The image carrier units $\mathbf{9}_Y$, $\mathbf{9}_M$, $\mathbf{9}_C$, $\mathbf{9}_B$ are arranged in tandem in this order from the upstream in the rotational direction of the intermediate transfer medium 10 (the counterclockwise direction in FIG. 17). It should be understood that the image carrier units $\mathbf{9}_Y$, $\mathbf{9}_M$, $\mathbf{9}_C$, $\mathbf{9}_B$ and the primary transferring devices $\mathbf{6}_Y$, $\mathbf{6}_M$, $\mathbf{6}_C$, $\mathbf{6}_B$ may be arranged in any order.

The intermediate transfer medium 10 in an endless belt shape is wound onto and tightly held by a driving roller 11 and a driven roller 12 and is driven to circulate by the driving roller 11 driven by a motor (not shown). By passing a paper 5 between the intermediate transfer medium 10 and the secondary transfer roller 6'*a* at the driving roller 11 with some pressure, the secondary transfer onto the paper 5 is carried out.

In the full-color image forming apparatus 1 of this embodiment, the image carriers $\mathbf{2}_Y$, $\mathbf{2}_M$, $\mathbf{2}_C$, $\mathbf{2}_B$, the writing electrodes $\mathbf{3}b_Y$, $\mathbf{3}b_M$, $\mathbf{3}b_C$, $\mathbf{3}b_B$, the development rollers $\mathbf{4}a_Y$, $\mathbf{4}a_M$, $\mathbf{4}a_C$, $\mathbf{4}a_B$, the primary transfer rollers $\mathbf{6}a_Y$, $\mathbf{6}a_M$, $\mathbf{6}a_C$, $\mathbf{6}a_B$, the transfer roller shifting mechanisms $\mathbf{19}_Y$, $\mathbf{19}_M$, $\mathbf{19}_C$, $\mathbf{19}_B$, and the surface potential adjusting members $\mathbf{8}_Y$, $\mathbf{8}_M$, $\mathbf{8}_C$, $\mathbf{8}_B$ are independently controlled. Accordingly, each transfer roller shifting mechanism $\mathbf{19}_Y$, $\mathbf{19}_M$, $\mathbf{19}_C$, $\mathbf{19}_B$ is individually controlled to bias the corresponding primary transfer roller $\mathbf{6}a_Y$, $\mathbf{6}a_M$, $\mathbf{6}a_C$, $\mathbf{6}a_B$, as shown in FIG. 17, to conduct the primary transfer operation for the corresponding color when the image area of the intermediate transfer medium 10 reaches the position to be in contact with the corresponding image carrier $\mathbf{2}_Y$, $\mathbf{2}_M$, $\mathbf{2}_C$, $\mathbf{2}_B$. Therefore, the corresponding primary transfer roller $\mathbf{6}a_Y$, $\mathbf{6}a_M$, $\mathbf{6}a_C$, $\mathbf{6}a_B$ brings the intermediate transfer medium 10 into contact with the chargeable layer $\mathbf{2}b_Y$, $\mathbf{2}b_M$, $\mathbf{2}b_C$, $\mathbf{2}b_B$ of the corresponding image carrier $\mathbf{2}_Y$, $\mathbf{2}_M$, $\mathbf{2}_C$, $\mathbf{3}_B$ so as to conduct the primary transfer (the solid lines for $\mathbf{6}a_Y$, $\mathbf{6}a_C$ in FIG. 17 indicate that developer images of yellow and cyan are primarily transferred).

On the other hand, each transfer roller shifting mechanism $\mathbf{19}_Y$, $\mathbf{19}_M$, $\mathbf{19}_C$, $\mathbf{19}_B$ is individually controlled to separate the corresponding primary transfer roller $\mathbf{6}a_Y$, $\mathbf{6}a_M$, $\mathbf{6}a_C$, $\mathbf{6}a_B$ from the intermediate transfer medium 10, as shown in FIG. 17, not to conduct the primary transfer operation for the corresponding color when the non-image area of the intermediate transfer medium 10 reaches the position to be in contact with the corresponding image carrier $\mathbf{2}_Y$, $\mathbf{2}_M$, $\mathbf{2}_C$, $\mathbf{3}_B$ (the solid lines for $\mathbf{6}a_M$, $\mathbf{6}a_B$ in FIG. 17 indicates that the primary transfer rollers $\mathbf{6}a_M$, $\mathbf{6}a_B$ for magenta and black are spaced apart from the intermediate transfer medium 10).

The other works and effects of the full-color image forming apparatus 1 of this embodiment are the same as those of the aforementioned eleventh embodiment shown in FIG. 16.

What we claim is:

1. An image forming apparatus comprising at least: an image carrier having a chargeable layer on which an electrostatic latent image is formed; a writing head having writing electrodes which are in contact with said chargeable layer of said image carrier to write said electrostatic latent image; a developing device having a developer carrier for carrying developer for developing said electrostatic latent image on said image carrier; a transferring device having a transfer member which is disposed to be in contact with said chargeable layer of said image carrier to transfer the developer image, developed by the developing device, on said image carrier to a recording medium; and a surface potential adjusting member which is disposed to be in contact with said chargeable layer between said writing electrodes and said transfer member and to which a predetermined voltage including 0 (zero) V is applied for adjusting the voltage of said chargeable layer at the portion to be in contact with said writing electrodes.

2. The image forming apparatus as claimed in claim 1, wherein said surface potential adjusting member rotates to have a predetermined peripheral surface speed ratio relative to said image carrier.

3. The image forming apparatus as claimed in claim 1 or 2, wherein said surface potential adjusting member has a cleaning function.

4. The image forming apparatus as claimed in claim 1, wherein said surface potential adjusting member is a rotatable conductive roller.

5. The image forming apparatus as claimed in claim 4, wherein said conductive roller is any one of a group consisting of a conductive fur brush, a conductive rubber roller, and a conductive magnetic brush.

6. The image forming apparatus as claimed in claim 1, wherein said predetermined voltage to be applied to said surface potential adjusting member is a voltage composed of an alternating current voltage superimposed on a direct current voltage.

7. The image forming apparatus as claimed in claim 6, wherein the value of said direct current voltage is set to be equal to the value of a bias voltage to be applied to said image carrier.

8. The image forming apparatus as claimed in claim 1, wherein the timing for conducting the application of voltages after the start of image forming is set such that the application of voltage to the surface potential adjusting member is first conducted for removing charge of said image carrier among the application of voltage to said image carrier, the application of voltage to said writing electrodes, the application of voltage to said developer carrier, the application of voltage to said transfer member, and the application of voltage to said surface potential adjusting member.

9. The image forming apparatus as claimed in claim 1, wherein the timing for stopping the application of voltages after the finish of the image forming process is set such that the application of voltage to the surface potential adjusting member is last stopped for removing charge of said image carrier among the application of voltage to said image carrier, the application of voltage to said writing electrodes, the application of voltage to said developer carrier, the application of voltage to said transfer member, and the application of voltage to said surface potential adjusting member.

10. The image forming apparatus as claimed in claim 1, wherein image carrier units each composed of said writing head, said developing device, said image carrier, and said surface potential adjusting member are provided for four colors of yellow, magenta, cyan, and black, respectively and wherein said image carrier units are disposed such that said image carriers thereof are in contact with an intermediate transfer medium and arranged sequentially along the moving direction of said intermediate transfer medium.

11. The image forming apparatus as claimed in claim 1, further comprising: a transfer member shifting mechanism which biases said transfer member against said chargeable layer to bring said recording medium into contact with said chargeable layer when said transfer voltage is applied and the operation of transferring the developer image on said image carrier to said recording medium is conducted and which separates said transfer member from said chargeable layer when the operation of transferring the developer image on said image carrier to said recording medium is not conducted.

12. The image forming apparatus as claimed in claim 1, wherein said surface potential adjusting member rotates to have a predetermined peripheral surface speed ratio relative to said image carrier; and wherein said surface potential adjusting member has a cleaning function.

13. The image forming apparatus as claimed in claim 12, wherein said surface potential adjusting member is a rotatable conductive roller.

14. The image forming apparatus as claimed in claim 13, wherein said conductive roller is any one of a group consisting of a conductive fur brush, a conductive rubber roller, and a conductive magnetic brush.

15. The image forming apparatus as claimed in claim 14, wherein said predetermined voltage to be applied to said surface potential adjusting member is a voltage composed of an alternating current voltage superimposed on a direct current voltage.

16. The image forming apparatus as claimed in claim 15, wherein the value of said direct current voltage is set to be equal to the value of a bias voltage to be applied to said image carrier.

17. The image forming apparatus as claimed in claim 16, wherein the timing for conducting the application of voltages after the start of image forming is set such that the application of voltage to the surface potential adjusting member is first conducted for removing charge of said image carrier among the application of voltage to said image carrier, the application of voltage to said writing electrodes, the application of voltage to said developer carrier, the application of voltage to said transfer member, and the application of voltage to said surface potential adjusting member.

18. The image forming apparatus as claimed in claim 17, wherein the timing for stopping the application of voltages after the finish of the image forming process is set such that the application of voltage to the surface potential adjusting member is last stopped for removing charge of said image carrier among the application of voltage to said image carrier, the application of voltage to said writing electrodes, the application of voltage to said developer carrier, the application of voltage to said transfer member, and the application of voltage to said surface potential adjusting member.

19. The image forming apparatus as claimed in 18, wherein image carrier units each composed of said writing head, said developing device, said image carrier, and said surface potential adjusting member are provided for four colors of yellow, magenta, cyan, and black, respectively and wherein said image cattier units are disposed such that said image carriers thereof are in contact with an intermediate transfer medium and arranged sequentially along the moving direction of said intermediate transfer medium.

20. An image forming apparatus comprising at least: an image carrier having a chargeable layer on which an electrostatic latent image is formed; a writing head having writing electrodes which are in contact with said chargeable layer to write said electrostatic latent image; a developing device for developing said electrostatic latent image on said image carrier with developer; and a transferring device having a transfer member which comes in contact with said chargeable layer of said image carrier so that the developer image, developed by the developing device, on said image carrier is transferred to a recording medium; wherein the transfer voltage applied to said transfer member is set such that the transfer voltage when said transfer member is in contact with said image carrier never exceeds the maximum applied voltage to said writing electrodes.

21. An image forming apparatus comprising at least: an image carrier having a chargeable layer on which art electrostatic latent image is formed; a writing head having writing electrodes which are in contact with said chargeable layer to write said electrostatic latent image; a developing device for developing said electrostatic latent image on said image carrier with developer; an intermediate transfer medium which comes in contact with said chargeable layer of said image carrier so that the developer image, developed by the developing device, on said image carrier is transferred to said intermediate transfer medium; and a transferring device having a transfer member for transferring the developer image on said intermediate transfer medium to a recording medium; wherein the intermediate transfer voltage applied to said intermediate transfer member is set such that the intermediate transfer voltage when said intermediate transfer medium is in contact with said image carrier never exceeds the maximum applied voltage to said writing electrodes.

22. An image forming apparatus comprising:

an image carrier having a chargeable layer on which an electrostatic latent image is formed;

a writing head having writing electrodes which are in contact with said chargeable layer to write said electrostatic latent image;

a developing device for developing said electrostatic latent image on said image carrier with developer;

a transferring device having a transfer member which brings a recording medium into contact with said chargeable layer of said image carrier to transfer the developer image on said image carrier to said recording medium by transfer voltage applied to said transfer member;

a transfer member shifting mechanism which biases said transfer member against said chargeable lover to bring said recording medium into contact with said chargeable layer when said transfer voltage is applied and the operation of transferring the developer image on said image carrier to said recording medium is conducted and which separates said transfer member from said chargeable layer when the operation of transferring the developer image on said image carrier to said recording medium is not conducted; and a surface potential adjusting member which is disposed to be in contact with said chargeable layer between said writing electrodes and said transfer member and to which a predetermined voltage including 0 (zero) V is applied for adjusting the voltage of said chargeable layer at the portion to be in contact with said writing electrodes.

23. An image forming apparatus composing at least: an image carrier having a chargeable layer on which an electrostatic latent image is formed; a writing head having writing electrodes which are in contact with said chargeable layer to write said electrostatic latent image; a developing device for developing said electrostatic latent image on said image carrier with developer; an intermediate transfer medium which comes in contact with said chargeable layer of said image carrier so that the developer image, developed by the developing device, on said image carrier is primarily transferred to said intermediate transfer medium; and a primary transferring device having a primary transfer member which brings said intermediate transfer medium into contact with said chargeable layer of said image carrier to primarily transfer the developer image on said image carrier to said intermediate transfer medium by transfer voltage applied to said primary transfer member; and a transfer member shifting mechanism which biases said primary transfer member against said chargeable layer to bring said intermediate transfer medium into contact with said chargeable layer when said transfer voltage is applied and the operation of primarily transferring the developer image on said image earner to said intermediate transfer medium is conducted and which separates said primary transfer member from said intermediate transfer medium when the operation of primarily transferring the developer image on said image carrier is not conducted.

24. The image forming apparatus as claimed in claim 23, further comprising a surface potential adjusting member which is disposed to be in contact with said chargeable layer between said writing electrodes and said primary transfer member and to which a predetermined voltage including 0 (zero) V is applied for adjusting the voltage of said chargeable layer at the portion to be in contact with said writing electrodes.

25. An image forming apparatus comprising; image carrier units provided for four colors of yellow, magenta, cyan, and black, respectively, each of said image carrier unit being composed of an image carrier having a chargeable layer on which an electrostatic latent image is formed, a writing head having writing electrodes which are in contact with said chargeable layer to write said electrostatic latent image, and a developing device for developing said electrostatic latent image on said image carrier with developer, wherein said image carrier units for respective colors are disposed such that said image carriers thereof are in contact with an intermediate transfer medium and arranged sequentially along the moving direction of said intermediate transfer medium, and wherein said image forming apparatus further comprises primary transferring devices provided for the respective colors, each of said primary transferring device having a primary transfer member which brings said intermediate transfer medium into contact with said chargeable layer of the corresponding image carrier so that the developer image on said image carrier is primarily transferred to said intermediate transfer medium by transfer voltage applied to said primary transfer member, and transfer member shifting mechanisms provided for the respective colors, each of which biases said primary transfer member against said chargeable layer to bring said intermediate transfer medium into contact with said chargeable layer when said transfer voltage is applied and the operation of primarily transferring the developer image on said image carrier to said intermediate transfer medium is conducted and separates said primary transfer member from said chargeable layer when the operation of primarily transferring the developer image on said image carrier is not conducted.

26. The image forming apparatus as claimed in claim 25, further comprising surface potential adjusting members provided for the respective colors, each of which is disposed to be in contact with said chargeable layer between said writing electrodes and said primary transfer member and to which a predetermined voltage including 0 (zero) V is applied for adjusting the voltage of said chargeable layer at the portion to be in contact with said writing electrodes.

27. An image forming apparatus comprising:

an image carrier having a chargeable layer on which an electrostatic latent image is formed;

a writing head having writing electrodes which axe in contact with said chargeable layer of said image carrier to write said electrostatic latent image;

a developing device having a developer carrier which carries developer for developing said electrostatic latent image on said image carrier;

a transferring device having a transfer member which comes in contact with said chargeable layer of said image carrier to transfer the developer image on said image carrier to a recording medium; and a voltage controller for controlling a transfer voltage to be applied to said transfer member not to exceed the maximum voltage to be applied to said writing electrodes when said transfer member and said image carrier are in contact with each other in a state in which no recording medium is located at a position between said transfer member and said image carrier.

* * * * *